US008021815B2

(12) United States Patent
Akioka

(10) Patent No.: US 8,021,815 B2
(45) Date of Patent: Sep. 20, 2011

(54) LIQUID DEVELOPER AND IMAGE FORMING DEVICE

(75) Inventor: Koji Akioka, North Adelaide (AU)

(73) Assignee: Seiko Epson Corporation, Tokyo (JP)

( * ) Notice: Subject to any disclaimer, the term of this patent is extended or adjusted under 35 U.S.C. 154(b) by 710 days.

(21) Appl. No.: 12/056,104

(22) Filed: Mar. 26, 2008

(65) Prior Publication Data

US 2008/0311505 A1 Dec. 18, 2008

(30) Foreign Application Priority Data

Jun. 14, 2007 (JP) ..... 2007-157969

(51) Int. Cl.
*G03G 9/135* (2006.01)

(52) U.S. Cl. ..... 430/114; 430/115; 430/116

(58) Field of Classification Search ..... 430/114, 430/115, 116
See application file for complete search history.

(56) References Cited

U.S. PATENT DOCUMENTS

| | | | | |
|---|---|---|---|---|
| 3,264,272 | A * | 8/1966 | Rees | 428/36.9 |
| 2005/0147929 | A1* | 7/2005 | Kellie et al. | 430/330 |
| 2007/0128534 | A1* | 6/2007 | Miyakawa | 430/115 |
| 2007/0128535 | A1* | 6/2007 | Miyakawa | 430/115 |
| 2007/0128536 | A1* | 6/2007 | Miyakawa | 430/115 |

FOREIGN PATENT DOCUMENTS

JP 2006-251253 9/2006

* cited by examiner

*Primary Examiner* — Hoa V Le
(74) *Attorney, Agent, or Firm* — DLA Piper LLP (US)

(57) ABSTRACT

A liquid developer includes a toner particle mainly composed of a resin material, and a nonvolatile insulating liquid, the resin material including an ethylene copolymer, and the insulating liquid including fatty acid triglyceride.

4 Claims, 3 Drawing Sheets

LIQUID DEVELOPER AND IMAGE FORMING DEVICE

BACKGROUND

1. Technical Field

The present invention relates to a liquid developer and an image forming device.

2. Related Art

As a developer used for developing an electrostatic latent image formed on a latent image carrying member, there are cited a dry toner having a toner composed of a material including a coloring matter such as a pigment and fixing resin used in a dry condition, and a liquid developer (a liquid toner) having a toner dispersed in an electrical insulating carrier liquid (insulating liquid) as disclosed in JP-A-2006-251253.

A method of using the dry toner has an advantage in handling because a solid toner is handled, but also has a concern of imposing an unfavorable influence of a powder to a human body and so on, and problems in stains caused by a scattered toner, uniformity in the dispersed toner, and so on. Further, in the dry toner, there arises a problem that aggregation of particles easily occurs, which makes it difficult to form toner particles with sufficiently small sizes, thus making it difficult to form a high-resolution toner image. Still further, in the case of forming the toner particles with relatively small sizes, the problems caused by the nature of the powder as described above become further conspicuous.

On the other hand, in the method of using a liquid developer, since the aggregation of the toner particles in the liquid developer is effectively prevented, fine toner particles can be used, and further, the fixing resin with a low softening point (low softening temperature) can be used. As a result, the method of using a liquid developer is provided with features of good reproducibility of fine line images, preferable gray-scale reproducibility, superior color reproducibility, and further a feature of being excellent as a high-speed image forming method.

However, in the liquid developer in the related art, although dispersibility of the toner particles is improved in comparison with dry toners, affinity between the insulating liquid and the toner particles is low, which makes it difficult to maintain a preferable dispersion condition for a long period of time. As a result, it is difficult to assure the shelf life and long-term stability of the liquid developer. Further, there arises a problem that an offset and so on is caused frequently in the fixing process at low temperature corresponding to recent energy saving.

SUMMARY

An advantage of some aspects of the invention is to provide a liquid developer superior in shelf life and long-term stability, and further in a low-temperature fixing property, and of providing an image forming device using such a liquid developer.

The advantage described above is obtained by the present invention described below.

According to an aspect of the invention, there is provided a liquid developer including a toner particle mainly composed of a resin material, and a nonvolatile insulating liquid, the resin material including an ethylene copolymer, and the insulating liquid including fatty acid triglyceride.

In the liquid developer according to another aspect of the invention, the toner particle preferably includes the fatty acid triglyceride.

In the liquid developer according to another aspect of the invention, assuming that a melting point of the ethylene copolymer is Tm (° C.), and a Vicat softening point of the ethylene copolymer is Tv (° C.), $Tm-Tv \leqq 35$ (° C.) is preferably satisfied.

In the liquid developer according to another aspect of the invention, a modulus of flexural rigidity of the ethylene copolymer measured at 25° C. in conformity to JIS K7106 is preferably in a range of 50 through 140 MPa.

In the liquid developer according to another aspect of the invention, the ethylene copolymer preferably includes one of an acrylic acid and a methacrylic acid as a monomer constituent.

According to another aspect of the invention, there is provided an image forming device including a plurality of developing sections, using a plurality of liquid developers with colors different from each other, for forming monochroic images corresponding to the respective colors, an intermediate transfer section, to which the monochroic images formed by the plurality of developing sections are sequentially transferred, for forming an intermediate transfer image composed of the monochroic images stacked one another, a secondary transfer section for transferring the intermediate transfer image to a recording medium to form an unfixed color image on the recording medium, and a fixing section for fixing the unfixed color image on the recording medium, wherein at least one of the plurality of liquid developers each include a toner particle mainly composed of a resin material, and a nonvolatile insulating liquid, the resin material including an ethylene copolymer, and the insulating liquid including fatty acid triglyceride.

In the image forming device according to another aspect of the invention, it is preferable that the plurality of developing sections each include a developing roller for forming a layer of the liquid developer on a surface of the developing roller, and a photoconductor for forming the monochroic image by transferring the liquid developer on the developing roller, at least a surface of the photoconductor being made of amorphous silicon.

By satisfying any of the above configurations, a liquid developer superior in shelf life and long-term stability, and further in a low-temperature fixing property can be provided, and further an image forming device using such a liquid developer can be provided.

BRIEF DESCRIPTION OF THE DRAWINGS

The invention will now be described with reference to the accompanying drawings, wherein like numbers refer to like elements.

DESCRIPTION OF EXEMPLARY EMBODIMENTS

Figure 1:
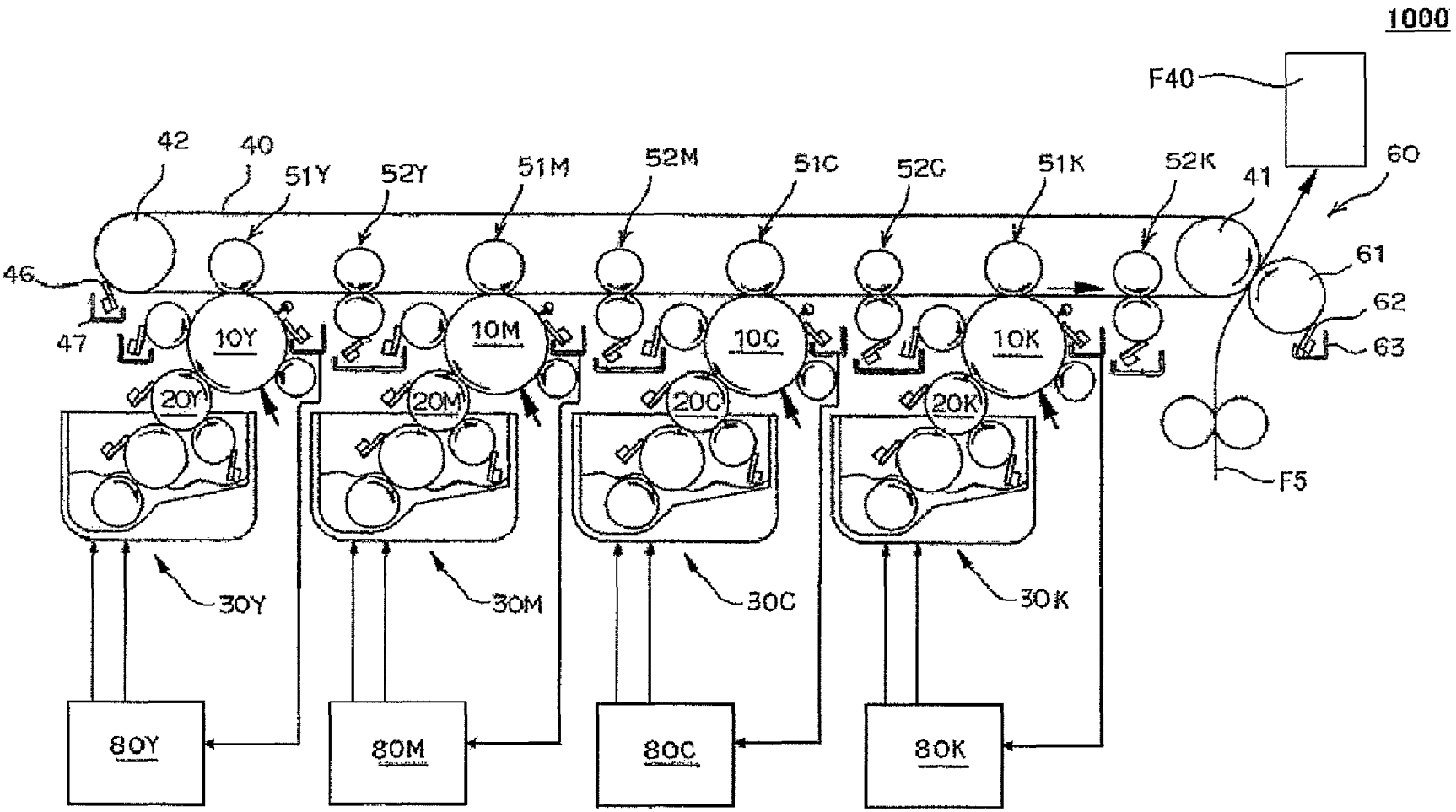
FIG. 1 is a schematic view showing an example of an image forming device to which a liquid developer according to an embodiment of the invention is applied.

Hereinafter, preferred embodiments of the invention will be described in detail.

Liquid Developer

The liquid developer according to an embodiment of the invention has toner particles composed mainly of a resin material, and dispersed in an insulating liquid.

Insulating Liquid

Firstly, the insulating liquid will be explained.

In the embodiment of the invention, the insulating liquid is made of a nonvolatile liquid. Since the insulating liquid is a nonvolatile liquid as described above, the insulating liquid can surely be prevented from vaporizing in the fixing process, thus volatile organic compounds (VOC) can surely be prevented from being generated. As a result, the liquid developer becomes particularly less harmful to the human body and organisms. Further, the liquid developer can be made environmentally friendly. It should be noted that in the present specification, a nonvolatile liquid specifically denotes a liquid having an initial boiling point measured in conformity to JIS K2254 of 105° C. or more, and preferably of 140° C. or more.

Further, in the present embodiment of the invention, the insulating liquid includes fatty acid triglyceride. It should be noted that fatty acid triglyceride is a mixed triester (triglyceride) of glycerin and fatty acid.

The fatty acid triglyceride is a liquid having high affinity with the resin material included in such a toner particle as described later. Therefore, since the insulating liquid includes the fatty acid triglyceride, the dispersibility of the toner particles in the liquid developer becomes excellent, thus the shelf life and the long-term stability of the liquid developer can be made excellent. Further, the fatty acid triglyceride has a property of entering into the molecular chain of the resin material forming the toner particles. Such fatty acid triglyceride has a plasticizing function for plasticizing the resin material forming the toner particles. Therefore, the toner particles into which the fatty acid triglyceride infiltrates can easily be melted to be fixed to a recording medium. Further, the toner particles thus plasticized can be fixed to the recording medium in a more appressed manner, thus the fixing strength of the toner image thus obtained becomes particularly excellent. For example, in the case of using paper as the recording medium, it becomes easy for the toner particles to get into the gap between the paper fibers. Further, a part of the toner particles (the resin material forming the toner particles) melted by the heat in the fixing process infiltrates into the recording medium, and the toner particles are cooled to be hardened in this condition, thus the toner particles can rigidly be fixed to the paper by an anchor effect. Therefore, the liquid developer including such toner particles is improved in the low-temperature fixing property, and the fixing strength of the toner particles to the recording medium becomes excellent. Further, since the fatty acid triglyceride is an environmentally friendly component, environmental burdens of the insulating liquid caused by leakage of the insulating liquid to the outside of the image forming device or disposal of the used insulating liquid can be reduced, and as a result, the environmentally friendly liquid developer can be provided.

Regarding such fatty acid triglyceride, the fatty acid component included in the fatty acid triglyceride is not particularly limited, but a saturated fatty acid such as butyric acid, caproic acid, caprylic acid, capric acid, lauric acid, myristic acid, palmitic acid, stearic acid, arachic acid, behenic acid, or lignoceric acid, an unsaturated fatty acid such as a monounsaturated fatty acid such as crotonic acid, myristoleic acid, palmitoleic acid, oleic acid, elaidic acid, vaccenic acid, gadoleic acid, erucic acid, or nervonic acid, or a polyunsaturated fatty acid such as linoleic acid, α-linolenic acid, γ-linolenic acid, arachidonic acid, eleostearic acid, stearidonic acid, clupanodonic acid, docosahexaenoic acid (DHA), or eicosapentaenoic acid (EPA), and derivatives thereof can be cited, and one or more kinds selected therefrom can be used alone or in combination as the fatty acid component.

In the case in which the fatty acid triglyceride includes the saturated fatty acid component out of the above acids, it becomes possible to keep the chemical stability of the liquid developer and the electrical insulation of the insulating liquid in further high levels. Thus, the shelf life and the long-term stability of the liquid developer become further excellent. Further, among the saturated fatty acids described above, those with the carbon number in a range of 6 through 22 are preferable, those with the carbon number in a range of 8 through 20 are further preferable, and those with the carbon number in a range of 10 through 18 is still further preferable. By including such saturated fatty acid components, the advantageous effects described above are remarkably exerted.

Further, in the case in which the unsaturated fatty acid is included in the fatty acid triglyceride, the fatty acid triglyceride can contribute to improvement of the long-term shelf life of the toner image obtained after the image forming process. The reason therefor can be thought as follows. The unsaturated fatty acid component is a component capable of hardening itself by being oxidized. Therefore, in the case in which the toner image is formed on the recording medium and fixed thereto using the liquid developer including the fatty acid triglyceride containing the unsaturated fatty acid, the fatty acid triglyceride remaining in the toner image together with the toner particles can be oxidatively polymerized by oxygen in the air, thus it becomes possible to firmly bond the toner particles with each other or the toner particles with the recording medium. Further, since the unsaturated fatty acid component of the fatty acid triglyceride can be oxidatively polymerized so as to cover the surfaces of the toner particles, a protective film made of the hardened fatty acid triglyceride can be formed on the surface of the toner particles. Therefore, the toner image having little deterioration caused by physical external force such as a friction, the air, or light over a long period of time can be obtained, thus the long-term shelf life becomes excellent.

Such a fatty acid triglyceride as described above can efficiently be obtained from naturally-occurring fats including plant-derived fats such as sunflower oil, safflower oil, rice oil, rice bran oil, rape oil, olive oil, sesame oil, canola oil, soybean oil, flaxseed oil, or castor oil, and various animal-derived fats such as butter.

Further, the content of the fatty acid triglyceride in the insulating liquid is preferably in a range of 20 through 90 wt %, further preferably in a range of 30 through 90 wt %, and still furtherpreferably in a range of 40 through 90 wt %. Thus, the dispersibilityof the tonerparticles inthe liquiddeveloper can be made particularly excellent, and at the same time, the chemical stability of the liquid developer can be made particularly excellent.

Further, the insulating liquid can include a known liquid as the insulating liquid in addition to the fatty acid triglyceride as described above. Specifically, there can be cited silicone oil such as KF96, KF4701, KF965, KS602A, KS603, KS604, KF41, KF54, FA630 (produced by Shin-Etsu Chemical Co., Ltd.), TSF410, TSF433, TSF434, TSF451, TSF437 (produced by Momentive Performance Materials Inc.), or SH200 (produced by Dow Corning Toray Co., Ltd.), aliphatic hydrocarbon such as TSOPAR-E, ISOPAR-G, ISOPAR-H, ISOPAR-L (produced by Exxon Mobil Corp.), Cosmo White P-60, Cosmo White P-70, Cosmo White P-120 (produced by Cosmo Oil Lubricants Co., Ltd.), Dyna Freshia W-8, Daphne Oil CP, Daphne Oil KP, Transformer Oil H, Transformer Oil G, Transformer Oil A, Transformer Oil B, Transformer Oil S (produced by Idemitsu Kosan Co., Ltd.), Shellsol 70, Shellsol 71 (produced by Shell Oil Company, Ltd.), Amsco OMS, Amsco 460 solvent (produced by American Mineral Spirits Company, Ltd.), low-viscosity/high-viscosity liquid paraffins (produced by Waco Pure Chemical Industries, Ltd.), octane, isooctane, decane, isodecane, decalin, nonane, dodecane, isododecane, cyclohexane, cyclooctane, cyclodecane, a resolvent of the fatty acid triglyceride such as fatty acid monoglyceride, fatty acid diglyceride, glycerine, or a fatty acid, a synthetic esters liquid such as Prifer 6813 (produced by UNIQUEMA), benzene, toluene, xylene, mesitylene, fatty acid monoester, and so on, and one species or a combination of two or more species out of these compounds can be used.

In the case in which the insulating liquid includes the fatty acid monoester among these compounds, the following advantage can be obtained. It should be noted that the fatty acid monoester is an ester of a fatty acid and a monohydric alcohol. In other words, the fatty acid monoester remarkably exerts the plasticizing effect for plasticizing the resin material included in the toner particles. Such a fatty acid monoester is a component having relatively low molecular weight and a high degree of affinity for the resin material forming the toner particles described above. Therefore, in the liquid developer including the fatty acid monoester as the insulating liquid, the fatty acid monoester penetrates into the toner particles, thus the toner particles can more preferably be plasticized. Thus, the toner particles can more firmly be fixed to the recording medium at low temperature, and the low-temperature fixing property of the liquid developer becomes more excellent. Further, the fatty acid monoester is an environmentally friendly component. Therefore, environmental burdens caused by leakage of the liquid developer to the outside of the image forming device or disposal of the used liquid developer can be reduced. As a result, the environmentally friendly liquid developer can be provided.

The fatty acid component forming the fatty acid monoester is not particularly limited, but an unsaturated fatty acid such as oleic acid, palmitoleic acid, linoleic acid, α-linolenic acid, γ-linolenic acid, arachidonic acid, docosahexaenoic acid (DHA), or eicosapentaenoic acid (EPA), a saturated fatty acid such as butyric acid, lauric acid, caproic acid, caprylic acid, capric acid, myristic acid, palmitic acid, stearic acid, arachic acid, behenic acid, or lignoceric acid, and soon can be cited, and one or more species selected therefrom can be used alone or in combination.

Further, in the case in which the insulating liquid includes a synthetic esters liquid, the following advantages can be obtained. Specifically, such a synthetic esters liquid is also a component for efficiently plasticizing the resin material forming the toner particles similarly to the fatty acid monoester. In the liquid developer including such a synthetic esters liquid, the synthetic esters liquid can penetrate into the toner particles to preferably plasticizing the toner particles. Thus, the toner particles can more firmly be fixed to the recording medium at low temperature, thus the low-temperature fixing property of the liquid developer becomes more excellent. Further, such a synthetic esters liquid is a chemically stable component. Therefore, in the liquid developer including such a synthetic esters liquid as the insulating liquid, the characteristic of the liquid developer becomes stable for a long period of time, thus the liquid developer particularly superior in long-term stability can be obtained.

Further, the aniline point of such a synthetic esters liquid is preferably 30° C. or lower, further preferably 15° C. or lower, and still further preferably 10° C. or lower. Thus, the effect of plasticizing the resin material exerted by the synthetic esters liquid described above becomes more remarkable, the low-temperature fixing property of the liquid developer becomes particularly excellent.

Further, in the case in which the insulating liquid includes aliphatic hydrocarbon as described above, the following advantages can be obtained. The aliphatic hydrocarbon generally has a high electrical resistance, and is chemically stable. Therefore, the liquid developer using the aliphatic hydrocarbon has particularly superior developing property and transferring property, and the resulting toner image becomes clear with particularly small number of defects. Further, the aliphatic hydrocarbon is a liquid with little moisture absorption. Therefore, in the case in which the aliphatic hydrocarbon is included in the insulating liquid, moisture absorption of the insulating liquid in the storage state can preferably be prevented, thus alteration (deterioration) of the insulating liquid can preferably be prevented.

Further, in the case in which the insulating liquid includes silicone oil, the following advantages can be obtained. Silicone oils are organic compounds having a skeleton composed of siloxane bonds. Silicone oils in general have high electrical resistance. Therefore, when a silicone oil is used as the insulating liquid, the liquid developer attains particularly high electrical resistance, and the toner images obtain excellent transferring property and developing property. Since the silicone oils have various viscosities depending on the type, appropriate selection of the silicone oil can result in a particularly appropriate viscosity of the liquid developer. Further, the silicone oil is generally a material which is chemically stable and has little impact on the human body. Therefore, the liquid developer can preferably be prevented from suffering from deterioration of the insulating liquid in the storage state, thus the environmental stability thereof becomes excellent. Further, the liquid developer, which is safe even in the case in which the insulating liquid leaks to the outside of an image forming device, can be provided.

Further, a dispersant for improving the dispersing property of the toner particles can be included in the liquid developer (the insulating liquid).

As such a dispersant, there are cited a polymeric dispersant such as polyvinyl alcohol, carboxymethyl cellulose, polyethylene glycol, AJISPER PB-821 (produced by Ajinomoto Fine-Techno. Co. Inc.), Solsperse® (produced by The Lubrisol Corp.), polycarboxylic acid and a salt thereof, a metal salt (e.g., a sodium salt) of polyacrylic acid, a metal salt (e.g., a sodium salt) of polymethacrylic acid, a metal salt (erg., a sodium salt) of polymaleic acid, a metal salt (e.g., a sodium salt) of acrylic acid-maleic acid copolymer, a metal salt (e.g., a sodium salt) of polystyrene sulphonic acid, or a polyamine fatty acid condensed polymer, clay minerals, silica, tri calcium phosphate, a metal salt of tri stearic acid (e.g., an aluminum salt), a metal salt of distearic acid (e.g., an aluminum salt and a barium salt), a metal salt (e.g., a calcium salt, a lead salt, and a zinc salt) of stearic acid, a metal salt (e.g., a cobalt salt, a manganese salt, a lead salt, and a zinc salt) of linolenic acid, a metal salt (e.g., an aluminum salt, a calcium salt, and a cobalt salt) of octanoic acid, a metal salt (e.g., a calcium salt, and a cobalt salt) of oleic acid, a metal salt (e.g., a zinc salt) of palmitic acid, a metal salt (e.g., a sodium salt) of dodecylbenzenesulfonic acid, a metal salt (e.g., a calcium salt, a cobalt salt, a manganese salt, a lead salt, and a zinc salt) of naphthenic acid, a metal salt (e.g., a calcium salt, a cobalt salt, a manganese salt, a lead salt, and a zinc salt) of naphthenic acid, a metal salt (e.g., a calcium salt, a cobalt salt, a manganese salt, a lead salt, and a zinc salt) of lysine acid, and so on.

In the case in which the polyamine fatty acid condensed polymer is used among the dispersants described above, the polyamine fatty acid condensed polymer can preferably be attached to the surfaces of the toner particles, thus undesirable aggregation of the toner particles can more efficiently be prevented. Further, the charging characteristics of the toner particles can be improved.

In the casein which the polyamine fatty acid condensed polymer is used, the content of the polyamine fatty acid condensed polymer in the liquid developer is preferably 0.5 through 7.0 parts by weight with respect to 100 parts by weight of the toner particles, and further preferably 1.0 through 5.0 parts by weight with respect thereto. Thus, the advantages obtained by using the polyamine fatty acid condensed polymer can be made more remarkable.

Further, the insulating liquid can include an antioxidant.

Further, an antistatic agent can be included in the liquid developer (the insulating liquid).

As the antistatic agent, there are cited a metal oxide such as zinc oxide, aluminum oxide, or magnesium oxide, a metal salt of benzoic acid, a metal salt of salicylic acid, a metal salt of alkyl salicylic acid, a metal salt of catechols acid, a metal-containing bisazo dye, Nigrosine dye, tetraphenyl borate derivatives, a quaternary ammonium salt, an alkyl pyridinium salt, chlorinated polyesters, a nitrofunic acid, and so on.

The electrical resistance of the insulating liquid at room temperature (20° C.) is preferably $1.0\times10^{11}$ Ωcm or higher, more preferably $1.0\times10^{12}$ Ωcm or higher, and even more preferably $2.0\times10^{12}$ Ωcm or higher.

Further, the dielectric constant of the insulating liquid is preferably 3.5 or lower.

Toner Particles

The toner particles will now be explained.

Constituent Material of Toner Particles (Toner Material)

The toner particles (toner) constituting the liquid developer according to the embodiment of the invention include at least an ethylene copolymer as a resin material.

According to the liquid developer provided with the toner particles including such an ethylene copolymer and the insulating liquid including the fatty acid triglyceride, the following advantages can be obtained. Specifically, the ethylene copolymer is a resin material having particularly high affinity with the fatty acid triglyceride. Therefore, in the liquid developer having such a composition, the toner particles are dispersed evenly in the insulating liquid in the storage state, thus the undesired aggregation of the toner particles can surely be prevented from occurring. Further, as described above, the fatty acid triglyceride included in the insulating liquid is a component having the plasticizing effect of penetrating between the molecular chains of the ethylene copolymer constituting the toner particles to plasticize the toner particles. In the fixing process, the distance between the molecular chains of the ethylene copolymer constituting the toner particles is increased by the heat applied to the toner particles to make it easy for the fatty acid triglyceride to penetrate between the molecular chains, resulting in remarkable exertion of the plasticizing effect described above. As a result, all of the storage stability, the long-term stability, and the low-temperature fixing property of the liquid developer become particularly excellent. Further, such an ethylene copolymer has a crystal structure. Therefore, even in the case in which the toner particles include the fatty acid triglyceride to be plasticized, components (e.g., colorant) of the toner particles described later can surely be prevented from seeping into the insulating liquid from the toner particles. Thus, the toner images thus formed become particularly superior in gray-scale reproducibility and color reproducibility.

As described above, the liquid developer according to the embodiment of the invention has the toner particles including the ethylene copolymer and the insulating liquid including the fatty acid triglyceride, thereby obtaining the excellent advantages described above. In contrast, in the case in which the liquid developer does not have the configuration described above, the excellent advantages described above can hardly be obtained. Specifically, in the case in which the toner particles do not include the ethylene copolymer, even if the fatty acid triglyceride included in the insulating liquid penetrates into the toner particles, the toner particles are not sufficiently plasticized, thus making it difficult to fix the toner particles onto the recording medium at sufficiently low temperature. Further, in the case in which the insulating liquid does not include the fatty acid triglyceride described above, it becomes difficult to preferably disperse the toner particles in the insulating liquid, and further, it becomes difficult to obtain the sufficient storage stability and long-term stability of the toner particles. It should be noted that although fatty acid monoester or synthetic esters liquid described above can also be cited as such an insulating liquid for plasticizing the resin material included in the toner particles, the insulating liquid composed only of such a liquid remarkably exerts the plasticizing effect described above also in the storage state to cause undesired aggregation of the toner particles.

Hereinafter, each of the components constituting the toner particles will be explained in detail.

Resin Material

As described above, the toner constituting the liquid developer includes at least the ethylene copolymer. It should be noted that the ethylene copolymer denotes a copolymer of ethylene and another monomer than ethylene.

Such an ethylene copolymer does not have an unsaturated bond in the principal chain, and is a resin material hardly altered by light and heat. Therefore, the toner particles including such an ethylene copolymer can more surely be prevented from alteration and aggregation of the toner particles even in the case of storing the liquid developer in a relatively high temperature environment. Therefore, when storing the liquid developer including such toner particles inside an image forming device, the toner particles can surely be prevented from fusing to be bonded with each other and causing aggregation inside the device heated in the working condition, thus the storage stability and the long-term stability of the liquid developer become excellent.

As such an ethylene copolymer, there are cited an ethylene-acrylate copolymer, an ethylene-methacrylate copolymer, ethylene vinyl acetate such as ethylene-vinyl acetate copolymer, partially saponified ethylene vinyl acetate, an ethylene-acrylic ester copolymer, an ethylene-methacrylic ester copolymer, and so on.

Further, as the monomer component constituting such an ethylene copolymer, there are cited acrylic acid, meth acrylic acid, an acrylic acid ester such as methyl acrylate or ethyl acrylate, a methacrylic acid ester such as methyl methacrylate or ethyl methacrylate, vinyl acetate, styrene, α-methylstyrene, and so on in addition to ethylene, and it is preferable to include acrylic acid or methacrylic acid among these components. The ethylene copolymer including such a monomer as the monomer component constituting the ethylene copolymer in addition to ethylene has particularly excellent affinity with the fatty acid triglyceride because of the similarity in chemical structure. Thus, the dispersibility of the toner particles in the insulating liquid becomes further superior in the storage state, and in the fixing process, the fatty acid triglyceride penetrates more preferably into the toner particles, thus more surely exerting the plasticizing effect. Therefore, the storage stability, the long-term stability, and the low-temperature fixing property of the liquid developer become further excellent.

Further, in the case in which the ethylene copolymer includes acrylic acid or methacrylic acid or both as the composing monomer component in addition to ethylene, the content of the acrylic acid or the methacrylic acid or both included in the ethylene copolymer is preferably in a range of 3 through 15 wt %, and further preferably in a range of 5 through 10 wt %. The toner particles having the ethylene copolymer satisfying the conditions described above as the constituent are more surely prevented from the insulating liquid including the fatty acid triglyceride penetrating the inside thereof in the storage state. Therefore, in the storage state, the toner particles are more surely prevented from being undesirably plasticized and fusing to be bonded with each other and causing aggregation. On the other hand, in the fixing process, the fatty acid triglyceride preferably penetrates into the toner particles, thus the plasticizing effect can more effectively be exerted. It is conceivable that such an advantage is obtained for the following reasons. Specifically, since the ethylene copolymer surely becomes to have the crystal structure in the storage state, the toner particles including such an ethylene copolymer is more surely be prevented from the penetration of the insulating liquid including the fatty acid triglyceride into the toner particles. On the other hand, in the fixing process, although the crystal of the ethylene copolymer as the constituent of the toner particles is fused, on that occasion, the fatty acid triglyceride in the insulating liquid is drawn by a carboxylic acid provided to the acrylic acid or the methacrylic acid or both to preferably penetrates between the molecular chains of the ethylene copolymer. It is conceivable that the advantage described above can be obtained because the phenomena described above occur respectively in the storage state and the fixing process.

Further, the melting point Tm (° C.) of such an ethylene copolymer is not particularly limited, but is preferably in a range of 80 through 140° C., further preferably in a range of 85 through 120° C., and still further preferably in a range of 85 through 115° C. Thus, the toner particles can surely be fixed to the recording medium in the fixing process. Further, even in the case in which the fixing temperature in the fixing process is relatively low, the toner particles can preferably be fixed to the recording medium. Still further, in the storage state, undesired deformation and aggregation of the toner particles can more surely be prevented from occurring. It should be noted that in the present specification, the melting point measured in conformity to, for example, JIS K7121 1987 can be used.

Further, the Vicat softening point Tv (° C.) of such an ethylene copolymer is not particularly limited, but is preferably in a range of 40 through 100° C., further preferably in a range of 45 through 95° C., and still further preferably in a range of 50 through 90° C. Thus, the aggregation of the toner particles and deformation of the toner particles in the storage state can more surely be prevented. It should be noted that in the present specification, the Vicat softening point measured in conformity to, for example, JIS K7206 1999 can be used.

Further, assuming that the melting point of the ethylene copolymer is Tm (° C.), and the Vicat softening point thereof is Tv (° C.), Tm−Tv−35 (° C.) is preferably satisfied, and Tm−Tv≦30 (° C.) is more preferably satisfied. In the liquid developer including the toner particles having the ethylene copolymer satisfying the conditions described above, also in the case in which the liquid developer is stored at relatively high temperature, the toner particles can surely be prevented from aggregation, and in the fixing process, the toner particles can be fixed to the recording medium at low temperature. Further, in the present embodiment of the invention, the liquid developer includes fatty acid triglyceride in the insulating liquid. Therefore, in the fixing process, since the fatty acid triglyceride more preferably infiltrates inside the toner particles to remarkably exert the plasticizing effect, the low-temperature fixing property of the liquid developer can further improved.

Further, such an ethylene copolymer preferably has a modulus of flexural rigidity measured in conformity to JIS K7106 of 50 through 140 MPa at 25° C. Thus, the deformation of the toner particles and aggregation of the toner particles in the storage state can more surely be prevented. Further, such toner particles become to more firmly be fixed to the recording medium, and at the same time, to be better prevented from being separated from the recording medium by an influence (e.g., a shock, light, and moisture) of the external environment. Thus, the toner image thus obtained becomes crisp without a defect over a long period. Further, as described later as a method of manufacturing a liquid developer, in the case in which the toner particles are obtained by kneading to pulverize the toner material including the ethylene copolymer satisfying the conditions described above as a constituent, the toner particles with uniform particle diameter can more stable be manufactured. Further, since the toner material can efficiently be kneaded to be ground, the manufacturing time of the liquid developer to be finally obtained can be reduced.

It should be noted that the resin material constituting the toner particles needs only include the ethylene copolymer, and can also include other resin materials. As such resin materials, known resin, for example, can be used.

Colorant

The toner particles can also contain a colorant. The colorant is not particularly limited, but known pigments and dyes, for example, can be used as the colorant.

Other Components

Further, the liquids described above as the insulation liquid can be included as the constituent (component) of the toner particles. Among the liquids described above, the toner particles preferably include the fatty acid triglyceride therein.

The toner particles can obtain the following advantages by including the fatty acid triglyceride as the constituent. Specifically, as described above, the fatty acid triglyceride is a component exerting the effect of penetrating into the toner particles to plasticize the toner particles when being included in the insulating liquid, and therefore, by having it be included in the toner particles, the plasticizing effect can more remarkably be exerted. Thus, it becomes easier to fix the toner particles to the recording medium at relatively low temperature, and at the same time, the fixing strength of the toner particles to the recording medium can be made more excellent. Further, since the toner particles and the insulating liquid each include the fatty acid triglyceride as constituents, the affinity between the toner particles and the insulating liquid is further improved, thus making the dispersibility of the toner particles in the liquid developer particularly excellent. Further, even in the case in which the liquid developer is stored for a long term at relatively high temperature, the toner particles can more surely be prevented from melting to aggregate. Therefore, by the toner particles including the fatty acid triglyceride therein, the liquid developer becomes particularly superior in all of the storage stability, the long-term stability, and the low-temperature fixing property.

Further, as a constituting material of the toner particles, besides the materials as described above, known waxes, known magnetic powders, zinc stearate, zinc oxide, cerium oxide, silica, titanium oxide, iron oxide, a fatty acid, a fatty acid metal salt, and so on can also be used.

Shape of Toner Particles

The average particle diameter of the toner particles composed of the materials as described above is preferably in a range of 0.7 through 3 μm, more preferably in a range of 0.8 through 2.5 μm, and even more preferably in a range of 0.8 through 2 μm. If the average particle diameter of the toner particles falls within the described range, the resolution of the toner images formed by the liquid developer can sufficiently be increased, while reducing variations in the properties of the individual toner particles, and increasing the reliability of the liquid developer as a whole. Further, dispersion of the toner particles to the insulating liquid can be preferable, and a high level of storage stability of the liquid developer can be achieved. It should be noted that in the present specification, "average particle diameter" denotes the average particle diameter based on volume unless otherwise noted.

The content of the toner particles in the liquid developer is preferably in a range of 10 through 60 wt %, and more preferably in a range of 20 through 50 wt %.

It should be noted that the viscosity (viscosity measured in conformity to JIS Z8809 at 25° C. using an oscillating viscometer) of the liquid developer composed of the components described above is preferably 1000 mPa·s or lower. According to this configuration, infiltration of the liquid developer into the recording medium becomes more preferable, and consequently, fixing characteristics of the toner particles to the recording medium becomes more preferable. Further, the image resulting on the recording medium becomes crisp without variations, and the liquid developer becomes particularly preferable as the liquid developer suitable for high speed image formation.

Further, the electrical resistance of the liquid developer composed of components as described above at room temperature (20° C.) is preferably $1.0\times10^{11}$ Ωcm or higher, and more preferably $1.0\times10^{12}$ Ωcm or higher.

Method of Manufacturing Liquid Developer

Hereinafter, a preferable embodiment of a manufacturing method of the liquid developer as described above will be explained.

First Embodiment

Firstly, a first embodiment of a method of manufacturing the liquid developer according to the invention will be explained.

The manufacturing method of the liquid developer according to the present embodiment includes a toner material preparation process for obtaining the toner material including the resin material including the ethylene copolymer, the colorant, and the fatty acid triglyceride, and a pulverizing process for pulverizing the toner material thus prepared in the insulating liquid to obtain a pulverized substance dispersion liquid.

Toner Material Preparation Process

Firstly, an example of method of preparing a powder (the toner material) composed mainly of an ethylene copolymer will be explained.

Although a toner material prepared by any method can be adopted as such a toner material, in the present embodiment, the toner materials such as resin material including the ethylene copolymer as described above, the colorant, and fatty acid triglyceride are kneaded to obtain a kneaded substance composed of the toner materials, and then the kneaded substance is coarsely pulverized to obtain a coarsely pulverized substance composed of the toner materials.

As described above, by kneading the toner materials such as the resin material and colorant, even in the case in which the materials constituting the toner particles include components hardly dispersed or compatible with each other in the pulverizing process described later, it is possible to obtain the condition in which the components are sufficiently compatible and micro-dispersed in the resulting kneaded substance. As a result, variations in the characteristics among the toner particles can be made sufficiently small. Further, by coarsely pulverizing the kneaded substance composed of the toner materials prior to the pulverizing process described later, the particle diameter of the toner particles can be made sufficiently small in the pulverizing process. Further, in the present process, by adding the fatty acid triglyceride in addition to the resin material including an ethylene copolymer and the colorant, the finally resulting toner particles have the fatty acid triglyceride evenly dispersed in the inside thereof. As a result, all of the storage stability, the long-term stability, and the low-temperature fixing property of the liquid developer become particularly excellent. Further, as described above, by adding the fatty acid triglyceride as the toner material, the efficiency of pulverizing the toner material is improved in the pulverizing process, thus the manufacturing time can be reduced, and the toner particles with a desired particle diameter can surely be obtained. Further, since the rigidity of the ethylene copolymer is reduced by the fatty acid triglyceride, formation of extremely small particles compared to the toner particles with a desired particle diameter can surely be prevented when pulverizing the toner material.

It should be noted that in kneading of the toner materials as described above, various kinds of kneading machines such as a biaxial kneader/extruder, a kneader, batch type triaxial rollers, continuous biaxial rollers, a wheel mixer, or a blade type mixer can be used. Among these machines, the biaxial kneader/extruder is preferably used as the kneading machine. Thus, the raw materials can efficiently be kneaded, and further, the air included in the raw materials can be removed.

Further, the method of pulverizing the kneaded substance is not particularly limited, but can also be executed using various pulverizing machines or crushing machines such as a ball mill, a vibrating mill, a jet mill, or a pin mill.

Pulverizing Process

In the present process, by wet-milling the constituting materials (the toner materials) of the toner particles thus prepared in the insulating liquid, the pulverized substance dispersion liquid is obtained.

As such an insulating liquid, the insulating liquid as described above can be used.

Further, the method of pulverizing the toner materials is not particularly limited, and the toner materials can preferably be wet-milled using, for example, various pulverizing or crushing machines used in the toner material preparation process.

It should be noted that in the toner material preparation process described above, the fatty acid triglyceride included as a constituent of the toner materials partially exits from the coarsely pulverized substance when wet-milling the toner materials in the present process, and becomes a constituent of the finally obtained insulating liquid.

By going through the above process, the liquid developer according to the embodiment of the invention having the toner particles including the ethylene copolymer dispersed in the insulating liquid including the fatty acid triglyceride can be obtained.

It should be noted that in the present embodiment the insulating liquid used for wet-milling the toner materials in the pulverizing process can be an insulating liquid with the fatty acid triglyceride or an insulating liquid without the fatty triglyceride. Further, it is possible that in the pulverizing process, the toner materials are pulverized in the insulating liquid without the fatty acid triglyceride, and the resulting pulverized substance dispersion liquid is added with the fatty acid triglyceride to be used as the liquid developer.

Further, although in the present embodiment, the explanation is presented assuming that the fatty acid triglyceride is included as the toner materials in the toner material preparation process, the fatty acid triglyceride can be eliminated from the toner materials.

Second Embodiment

Then, a second embodiment of the method of manufacturing the liquid developer according to the invention will be explained.

The manufacturing method of the present embodiment includes a resin solution preparation process for preparing a resin solution having the resin material including the ethylene copolymer dissolved in a first liquid including the fatty acid triglyceride, and a resin deposition process for forming resin fine particles (the toner particles) by adding a second liquid with lower solubility of the resin material including the ethylene copolymer than the first liquid to the prepared resin solution to deposit the resin material in the resin solution. Further, in the manufacturing method of the liquid developer according to the present embodiment, there are provided prior to the resin solution preparation process, a kneading process for obtaining a kneaded substance by kneading the resin material including the ethylene copolymer and the colorant, and a pulverizing process for obtaining a pulverized substance by pulverizing the kneaded substance. Thus, the liquid developer according to the embodiment of the invention having the toner particles including the ethylene copolymer dispersed in the insulating liquid including the fatty acid triglyceride can easily and surely be obtained. Further, by adopting such a manufacturing method, the toner particles become to include the fatty acid triglyceride in the inside thereof, thus the storage stability, the long-term stability, and the low-temperature fixing property of the finally resulting liquid developer become particularly excellent. Further, by depositing the resin material using the insulating liquid to form the toner particles as described above, the manufacturing method of the liquid developer, which does not require pulverization of the constituting materials of the toner particles and is energy saving, can be achieved. Further, the first and second liquids used for deposition of the resin material are nonvolatile liquids in the present embodiment. Therefore, the first and second liquids can be used as constituents of the liquid developer, and there is no need for removing unnecessary liquids by, for example, distillation. Therefore, the manufacturing method of the liquid developer superior in productivity, and capable of effectively utilizing resources can be obtained.

Kneading Process

Firstly, the resin material including the ethylene copolymer and the colorant are kneaded to obtain a kneaded substance.

The raw materials used for kneading include the ethylene copolymer and the colorant as described above. In particular, by the raw material including the colorant, the air (in particular, the air held by the colorant) included in the raw material can efficiently be removed in the present process, thus bubbles can effectively be prevented from getting mixed into (remaining in) the toner particles. Further, by evenly kneading the resin material and the colorant as described above, the dispersibility and the solubility of the colorant in the resin solution described later can be made particularly excellent, and consequently, the resulting toner particles become to have the colorant distributed evenly. The raw materials to be used for kneading preferably include these components mixed previously For kneading the raw materials as described above, various kinds of kneading machines such as a biaxial kneader/extruder, a kneader, batch type triaxial rollers, continuous biaxial rollers, a wheel mixer, and a blade type mixer can be used. Among these machines, the biaxial kneader/extruder is preferably used as the kneading machine. Thus, the raw materials can efficiently be kneaded, and further, the air included in the raw materials can be removed.

Further, the raw materials used for kneading can also include the dispersant as described above. Thus, since the dispersibility and the solubility of the colorant in the resin solution described later can be made particularly excellent, the resulting toner particles become to have the colorant particularly evenly distributed.

Pulverizing Process

Subsequently, the kneaded substance described above is pulverized to obtain a pulverized substance. By pulverizing the kneaded substance as described above, the resin solution described later can be obtained as a more homogeneous solution with relative ease. As a result, even in the finally resulting liquid developer, the size of the toner particles ban be made smaller, thus preferably used for forming a high-resolution image.

The pulverizing method is not particularly limited, and pulverizing can be executed using various pulverizing machines or crushing machines such as a ball mill, a vibrating mill, a jet mill, or a pin mill.

The pulverizing process can be executed by dividing into a plurality of times (e.g., two stages of a coarse pulverizing process and a fine pulverizing process). Further, after such a pulverizing process, a process such as a classification process can also be executed if necessary. As the classification process, a bolter, an airflow classification machine, and so on can be used.

Resin Solution Preparation Process

Subsequently, the resin solution having the resin material including the ethylene copolymer dissolved in the first liquid including the fatty acid triglyceride is prepared. By thus dissolving the resin material into the first liquid including the fatty acid triglyceride, the toner particles become to surely include the fatty acid triglyceride.

The resin solution can be prepared by any method, such that the pulverized substance described above and the first liquid including the fatty acid triglyceride are mixed by an agitator such as a high-speed agitator. Thus, the resin material included in the pulverized substance can surely dissolves in the first liquid, and further, the colorant can surely be dispersed or dissolved in the first liquid.

The agitator, which can be used for preparing the resin solution, is not particularly limited, and as such an agitator there can be cited an attrition, a ball mill, a planetary ball mill, a bead mill, a sand mill, a high-speed mixer, a homogenizer, and so on.

Further, in the present process, a device for performing mixing while adding the resin material to the pulverized substance described above can also be adopted. In this case, the concentration of the colorant of the toner particles can easily be adjusted in the resulting liquid developer.

Further, in the present process, when mixing the pulverized substance and the first liquid, these materials can be heated. Thus, the resin material can surely be dissolved in the first liquid. Further, in such as case, the material temperature of the materials constituting the resin solution is preferably in a range of 80 through 160° C., and more preferably in a range of 90 through 140° C. Thus, the resin material can easily and surely be dissolved in the first liquid. Further, with the material temperature as described above, alteration, volatilization, and so on of the components included in the resin solution can surely be prevented.

Further, as the first liquid, any liquids including the fatty acid triglyceride as described above and capable of solving the resin material can be adopted, and other components can also be included therein. For example, a part of the insulating liquid constituting the liquid developer as described above can also be included therein. Further, the dispersant or the like can also be included therein.

The rate of the solid content in the resin solution is not particularly limited, and is preferably in a range of 20 through 60 wt %, and more preferably in a range of 30 through 50 wt %. In the case in which the rate of solid content is in the range described above, the viscosity characteristic of the resin solution can be made particularly preferable while surely dissolving the resin material in the first liquid. Further, the concentration of the toner particles in the resulting liquid developer can be made sufficiently high.

Resin Deposition Process

Subsequently, the second liquid, which has lower solubility of the resin material including the ethylene copolymer than the first liquid, is added thereto, thereby depositing the resin material in the resin solution to form the resin fine particles (the toner particles). Thus, the liquid developer having the toner particles including the ethylene copolymer dispersed in the insulating liquid including the fatty acid triglyceride can be obtained. Such a second liquid is generally composed mainly of the insulating liquid of the liquid developer. Further, the resin fine particles thus obtained include fatty acid triglyceride. In a detailed explanation, when the second liquid is added to deposit the resin material as the resin fine particles, the resin material is deposited while taking a part (the fatty acid triglyceride) of the first liquid with higher affinity (solubility) therein. Further, since the resin fine particles are deposited after the resin material is once dissolved in the fatty acid triglyceride as described above, the resin fine particles include the fatty acid triglyceride included in the first liquid. Further, the fatty acid triglyceride becomes to be included evenly in the resin fine particles. Further, by thus depositing the resin fine particles, the resin fine particles (the toner particles) with narrow particle diameter distribution in a desired particle diameter can be obtained.

The second liquid is only required to have lower solubility of the resin material than the first liquid, and the constituent of the insulating liquid of the liquid developer described above can be used for example, and further, the aliphatic hydrocarbon as described above or silicone oil or both are preferably included. Thus, the resin fine particles (toner particles) with a uniform size in a desired particle diameter can easily and surely be obtained. The reason therefor can be thought as follows. The aliphatic hydrocarbon and the silicone oil are each have low solubility of the resin material, and at the same time superior in affinity with the fatty acid triglyceride. Therefore, when the aliphatic hydrocarbon or the silicone oil or both are added to the resin solution, these liquid components are rapidly dispersed into the resin solution, thus the concentration variation of the aliphatic hydrocarbon or the silicone oil or both in the resin solution can surely be prevented from occurring. Therefore, it is conceivable that the resin fine particles with even size are promoted to be deposited and grown in the resin solution.

Further, addition of the second liquid to the resin solution can be executed by any methods, but a method of dropping the second liquid while agitating the resin solution is preferable. Thus, the concentration variation of the second liquid in the resin solution can surely be prevented from occurring, thus the resin particles with particularly even size can be obtained.

Any devices can be used for agitation of the resin solution, but devices capable of applying shearing force in a high speed are preferable, and for example, a planetary mixer, a homogenizer, a homo mixer can be used. Thus, the second liquid added thereto can rapidly be dispersed and dissolved therein, thereby surely preventing the concentration variation of the second liquid form occurring. Further, the resin fine particles once formed can surely be prevented from collapsing while making the resin fine particles efficiently be deposited. As a result, the resin fine particles with small variations in shape and particle diameter among the particles can efficiently be obtained.

Further, the material temperature in the present process is preferably in a range of 5 through 160° C., and further preferably in a range of 10 through 150° C. Thus, the liquid developer can easily and surely be obtained while preventing alteration and decomposition of the materials.

Further, in the present process, the temperature of the resin solution is not required to be constant. For example, the resin solution gradually lowering its temperature can also be adopted. Thus, the solubility of the resin material in the resin solution can be lowered to make it easy to deposit the resin fine particles. Therefore, the manufacturing method of the liquid developer becomes particularly superior in productivity. In this case, it is possible to lower the temperature of the resin solution when the second liquid is added or to lower the temperature of the resin solution after the second liquid is added.

Further, in the present process, an antistatic agent, a dispersant, and so on can also be added. Addition of these agents can be performed after the second liquid is added or before the second liquid is added. Further, the addition thereof can be performed simultaneously with the addition of the second liquid.

Further, a liquid can further be added thereto after the second liquid is added. Thus, adjustment of the concentrations of the insulating liquid and the toner particles in the liquid developer can easily be performed. In this case, the liquid to be added can have the same composition as the first and second liquids or a different composition therefrom. Further, the liquid developer can be prepared by replacing the liquid for dispersing the resin fine particles with another liquid after the second liquid is added to deposit the resin fine particles. Further, in this case, a part of the liquid for dispersion can be replaced or the whole liquid can be replaced.

Third Embodiment

Then, a third embodiment of the method of manufacturing the liquid developer according to the invention will be explained.

The manufacturing method according to the present embodiment includes a resin swelling liquid preparation process for heating a composition (a resin dispersion liquid) including the resin material including the ethylene copolymer and the insulating liquid including the fatty acid triglyceride, thereby preparing a resin swelling liquid having the resin material swollen with the insulating liquid, and a resin deposition process for cooling the resin swelling liquid, thereby depositing the resin material in the resin swelling liquid to form the resin fine particles (the toner particles) composed mainly of the resin material and including the insulating liquid therein. Further, in the manufacturing method of the liquid developer according to the present embodiment, similarly to the second embodiment of the manufacturing method of the liquid developer described above, there are provided prior to the resin swelling liquid preparation process, a kneading process for obtaining a kneaded substance by kneading the resin material including the ethylene copolymer and the colorant, and a pulverizing process for obtaining a pulverized substance by pulverizing the kneaded substance. Thus, the liquid developer as described above can easily and surely be obtained, and it is possible to make the toner particles constituting the liquid developer easily and surely include the insulating liquid. Further, by adopting such a manufacturing method, the toner particles become to include the fatty acid triglyceride in the inside thereof, thus the storage stability, the long-term stability, and the low-temperature fixing property of the finally resulting liquid developer become particularly excellent. Further, similarly to the second embodiment of the manufacturing method of the liquid developer, also in the present embodiment, there is no need for pulverization of the constituting materials of the toner particles and an energy saving manufacturing method of the liquid developer can be achieved.

Kneading Process

Firstly, the resin material including the ethylene copolymer and the colorant are kneaded to obtain a kneaded substance.

The raw materials used for kneading include the ethylene copolymer and the colorant as described above. In particular, by the raw material including the colorant, the air (in particular, the air held by the colorant) included in the raw material can efficiently be removed in the present process, thus bubbles can effectively be prevented from getting mixed into (remaining in) the toner particles. Further, by evenly kneading the resin material and the colorant as described above, a pulverized substance dispersed in the resin solution described later has the colorant evenly dispersed therein, and as a result, the resulting toner particles have the colorant particularly evenly dispersed therein. The raw materials to be used for kneading preferably include these components mixed previously.

For kneading the raw materials as described above, various kinds of kneading machines such as a biaxial kneader/extruder, a kneader, batch type triaxial rollers, continuous biaxial rollers, a wheel mixer, and a blade type mixer can be used. Among these machines, the biaxial kneader/extruder is preferably used as the kneading machine. Thus, the raw materials can efficiently be kneaded, and further, the air included in the raw materials can be removed.

Further, the raw materials used for kneading can also include the dispersant as described above. Thus, since the dispersibility and the solubility of the colorant in the resin swelling liquid described later can be made particularly excellent, the resulting toner particles become to have the colorant particularly evenly distributed.

Pulverizing Process

Subsequently, the kneaded substance described above is pulverized to obtain a pulverized substance including fine particles. By pulverizing the kneaded substance as described above, the resin swelling liquid described later can be obtained as a more homogeneous liquid with relative ease. As a result, even in the finally resulting liquid developer, the size of the toner particles can be made smaller, thus preferably used for forming a high-resolution image.

The pulverizing method is not particularly limited, and pulverizing can be executed using various pulverizing machines or crushing machines such as a ball mill, a vibrating mill, a jet mill, or a pin mill.

The pulverizing process can be executed by dividing into a plurality of times (e.g., two stages of a coarse pulverizing process and a fine pulverizing process). Further, after such a pulverizing process, a process such as a classification process can also be executed if necessary. As the classification process, a bolter, an air flow classification machine, and so on can be used.

Resin Swelling Liquid Preparation Process

Subsequently, the composition (the resin dispersion liquid) formed by adding the insulating liquid including the fatty acid triglyceride to the pulverized substance including the resin material including the ethylene copolymer and the colorant is prepared, and by heating the resin dispersion liquid, the resin swelling liquid having the resin material (the pulverized substance) swollen with the insulating liquid is prepared. By heating the resin dispersion liquid having the resin material including the ethylene copolymer and the insulating liquid including the fatty acid triglyceride as described above, the resin material includes the fatty acid triglyceride included in the insulating liquid to be swollen in the resin dispersion liquid. Thus, the resin fine particles obtained in the resin deposition process described later can be made include the fatty acid triglyceride, as a result, the toner particles constituting the finally resulting liquid developer become to include the fatty acid, triglyceride in the inside thereof.

As the insulating liquid for constituting the resin dispersion liquid, the insulating liquid described above can be used in addition to the fatty acid triglyceride.

The resin dispersion liquid can be prepared by any method, such that the pulverized substance and the insulating liquid described above are mixed by an agitator such as a high-speed agitator.

Thus, the pulverized substance can evenly be dispersed in the insulating liquid. Further, the colorant can surely be dispersed in the insulating liquid.

As the agitator, which can be used for preparing the resin dispersion liquid, there can be cited an attrition, a ball mill, a planetary ball mill, a bead mill, a sand mill, a high-speed mixer, a homogenizer, and so on, and among these devices, the high-speed mixer is particularly preferable. Further, such a high-speed mixer can be provided with one stirring blade or a plurality of stirring blades, and in the agitator having a plurality of stirring blades each orbiting while rotating, shearing force can preferably be applied to the resin dispersion liquid. As such a high-speed mixer, specifically, DESPA (produced by Asada Iron Works Co., Ltd.), a planetary mixer, T. K. HIVIS MIX 2P-03 type blade, T. K. ROBOMIX®/T. K. HOMO DISPER model 2.5 type blade (produced by PRIMIX Corp.), and so on can be used.

Subsequently, the resin dispersion liquid thus obtained is heated. Thus, the fatty acid triglyceride infiltrates between the molecules of the resin material in the pulverized substance, and the resin swelling liquid having the resin material in the pulverized substance absorbing the fatty acid triglyceride to be swollen is prepared.

The resin material (the pulverized substance) thus swollen with the insulating liquid becomes to have flexibility, and the shape thereof becomes unstable. Such a pulverized substance becomes to be easily changed in shape, and it is possible to prepare the toner particles with a desired shape and particle diameter by changing the rate of cooling the resin swelling liquid in the resin deposition process described later.

Further, it is possible to heat the resin dispersion liquid while agitating the resin dispersion liquid using the agitator or the like. Thus, the particle diameter of the pulverized substance swollen in the resin swelling liquid can be adjusted, thus the resin fine particles with a desired shape and particle diameter can more easily be prepared in the resin deposition process described later. As such an agitator, the agitator used for preparing the resin dispersion liquid as described above, for example, can also be used.

Further, the temperature at which the resin dispersion liquid is heated is preferably higher than the melting point of the resin material included in the resin dispersion liquid. Thus, the resin material in the pulverized substance more surely absorbs the insulating liquid between the molecules thereof, thereby the pulverized substance in the resin swelling liquid is more preferably swollen. Thus, the shape of the resin fine particles obtained in the resin deposition process described later can more easily be prepared.

Further, in the present embodiment of the invention, the liquid developer includes fatty acid triglyceride in the insulating liquid. According to this configuration, the following advantages can be obtained. Specifically, when the heat is applied to the resin dispersion liquid, the fatty acid triglyceride has a property of making the resin material be swollen, but does not have such a high solubility as to make the resin material be dissolved. Therefore, the resin material constituting the pulverized substance can preferably be prevented from seeping into the resin swelling liquid. Thus, the particle diameter distribution of the resin fine particles deposited in the resin deposition process described later can be made narrower, thereby more surely preventing the variation in the characteristics such as charging characteristics among the toner particles from occurring, Further, such an insulating liquid can include the dispersant as described above. Thus, the dispersibility of the pulverized substance thus swollen in the resin swelling liquid is improved, the aggregation of the pulverized substance in the resin swelling liquid can more surely be prevented, and the particle diameter and the shape of the toner particles can easily be adjusted.

The rate of the solid content in the resin swelling liquid is not particularly limited, and is preferably in a range of 20 through 60 wt %, and more preferably in a range of 30 through 50 wt %. In the case in which the rate of the solid content is in the range described above, the pulverized substance preferably absorbs the insulating liquid, and is more surely be swollen. Further, the viscosity of the resin swelling liquid becomes preferable, and aggregation of the swollen pulverized substance in the resin swelling liquid can more surely be prevented. Further, the concentration of the toner particles in the resulting liquid developer can be made sufficiently high.

Further, in the present process, an insulating liquid can further be added thereto after the resin swelling liquid has been prepared. Thus, the swollen pulverized substance can more evenly be dispersed in the resin swelling liquid, and the concentration of the solid content in the resin swelling liquid can easily be adjusted. Thus, the resin fine particles with more even particle diameter can be deposited in the resin swelling liquid developer in the resin deposition process described later.

Resin Deposition Process

Subsequently, the resin swelling liquid in the heated condition is cooled to deposit the resin material including the ethylene copolymer therein in the resin swelling liquid, thus forming the resin fine particles (the toner particles) including the fatty acid triglyceride in the inside thereof. By thus cooling the pulverized substance (the resin material), which the heat is applied to, and absorbs the fatty acid triglyceride to be swollen, some of the fatty acid triglyceride slips out from between the molecules of the resin material contained in the pulverized substance to form the insulating liquid for constituting the finally resulting liquid developer. Further, the fatty acid triglyceride, which does not slip out from between the molecules, remains in the resin material as it is, and form a constituent of resin fine particles (the toner particles). Since such resin fine particles (the toner particles) become to include the insulating liquid (the fatty acid triglyceride) in the inside thereof, the dispersibility with the insulating liquid including the fatty acid triglyceride becomes excellent, and as a result, the storage stability and the long-term stability of the liquid developer become excellent.

Further, the resin fine particles (the toner particles) thus deposited become to have an a spherical shape with a plurality of protrusions on the surface thereof. The toner particles having such a shape are melted in the condition in which the protrusions on the surface of the toner particles are engaged with the unevenness of the surface of the recording medium and then fixed to the recording medium. In particular, in the case in which paper is used as the recording medium, since the protrusions on the surface of the toner particles enter the gaps of the fiber of the paper and are melted there, the anchor effect is exerted, and thus, the toner particles can firmly be fixed to the paper. Further, the toner image formed by fixing such toner particles becomes to represent the unevenness of the surface of the recording medium (e.g., paper), the image display superior in stereoscopic effect becomes possible.

Although the cooling rate of such a resin swelling liquid varies in accordance with the combination of resin material and the insulating liquid used actually, assuming that the temperature (deposition start temperature) at which the resin material starts being deposited in the resin swelling liquid when the resin swelling liquid in the heated condition is cooled is Ti (° C.), the rate of cooling the resin swelling liquid to Ti (° C.) is not particularly limited, the rate of cooling the resin swelling liquid from Ti (° C.) (or higher than Ti (° C.) within 5° C.) is preferably set to low. Specifically, cooling at −1 through −5° C./hour is preferable. Thus, deposition of the resin material can be started when the temperature becomes lower than Ti (° C.), and using the resin material thus deposited as a core, the resin material can be further deposited on the surface of the core resin material, thus the resin fine particles (the toner particles) having an a spherical shape and grown to have protrusions can be manufactured. Further, by thus lowering the rate of cooling the resin swelling liquid from the temperature Ti (° C.), the particle diameter of the resin fine particles thus deposited in the resin swelling liquid is homogenized, thus a coarse particle or an extremely microscopic particle can surely be prevented from being included in the finally resulting liquid developer.

Further, when cooling the resin swelling liquid, the resin swelling liquid is preferably agitated using the agitator as described above. Thus, the shape and size of the resin fine particles (the toner particles) thus formed can be homogenized, and a coarse particle can more surely be prevented from being generated as the resin fine particles, thus the characteristics of the resulting liquid developer can be made more stable.

By thus depositing the resin material in the resin swelling liquid and then cooling it to the room temperature (20° C.), the liquid developer having the resin fine particles (the toner particles) including the fatty acid triglyceride in the inside thereof dispersed in the insulating liquid including the fatty acid triglyceride can be obtained.

Further, in the present process, an antistatic agent, a dispersant, and so on can also be added. Addition of these agents can be performed prior to cooling the resin swelling liquid or after the deposition of the resin material has been completed. Further, the addition can be performed while cooling the resin swelling liquid.

Further, in the present process, an insulating liquid can further be added. Such an insulating liquid can be added in the process of deposition of the resin material, or after the process has been completed.

Image Forming Device

An embodiment of an image forming device according to the invention will hereinafter be described. The image forming device according to an embodiment of the invention is for forming a color image on a recording medium using the liquid developer according to the embodiments of the invention as described above.

Figure 2:
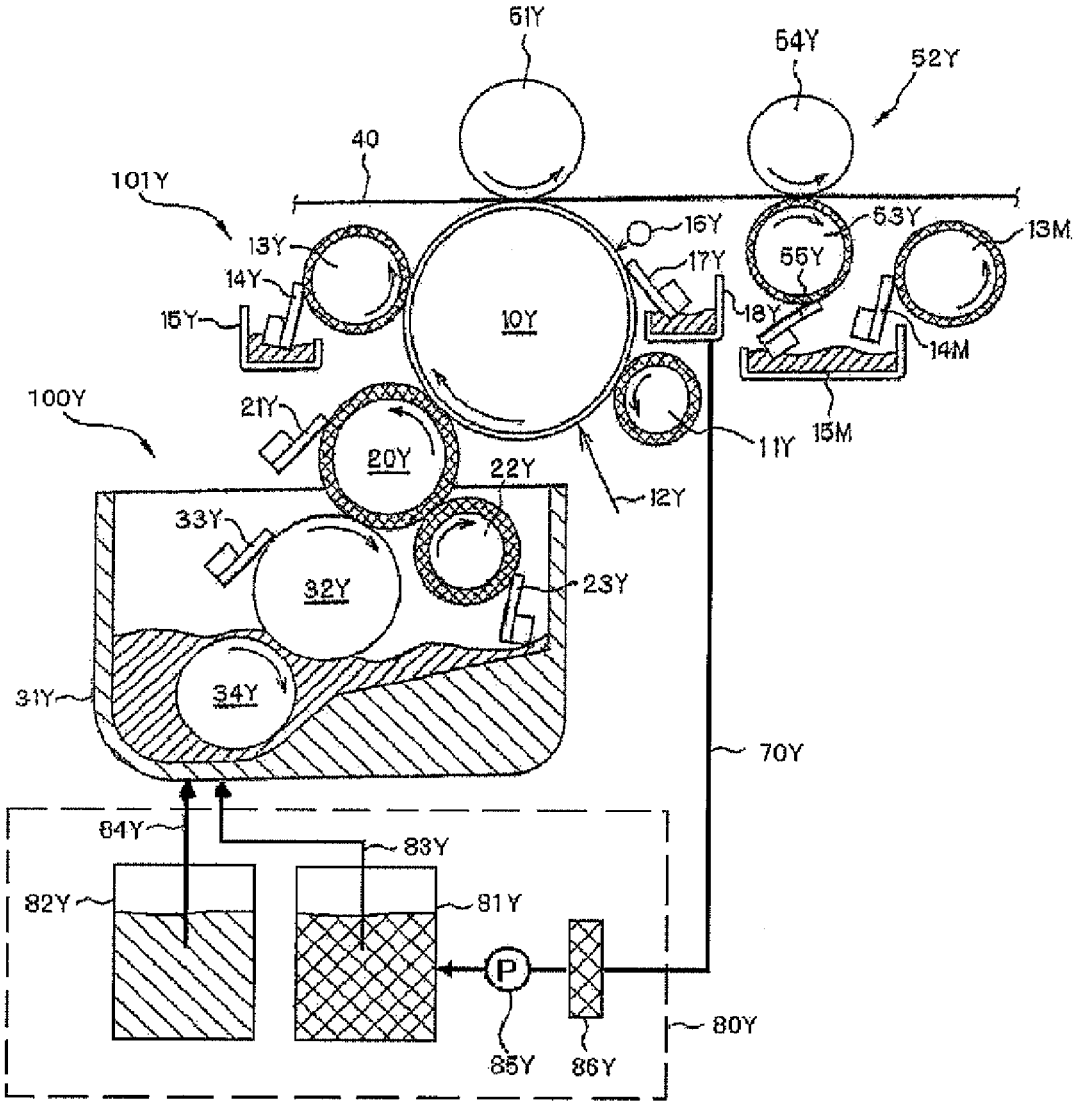
FIG. 2 is an enlarged view of a part of the image forming device shown in FIG. 1.
Figure 3:
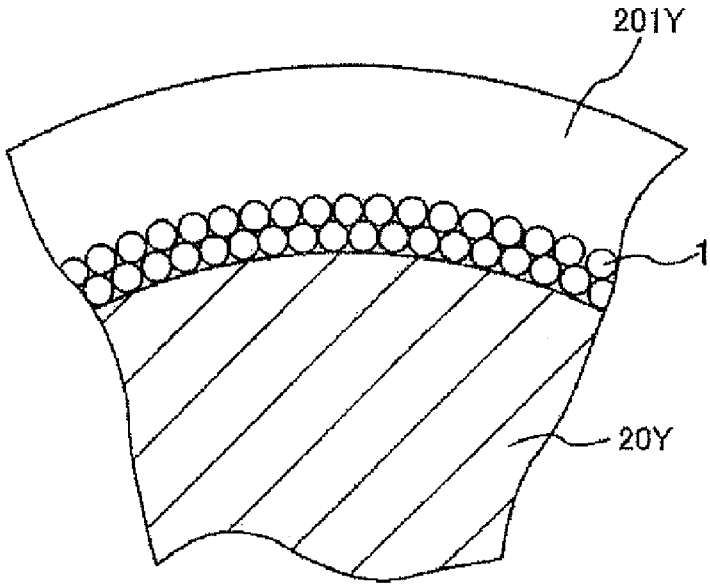
FIG. 3 is a schematic view showing a condition of toner particles in a liquid developer layer on a developing roller.
Figure 4:
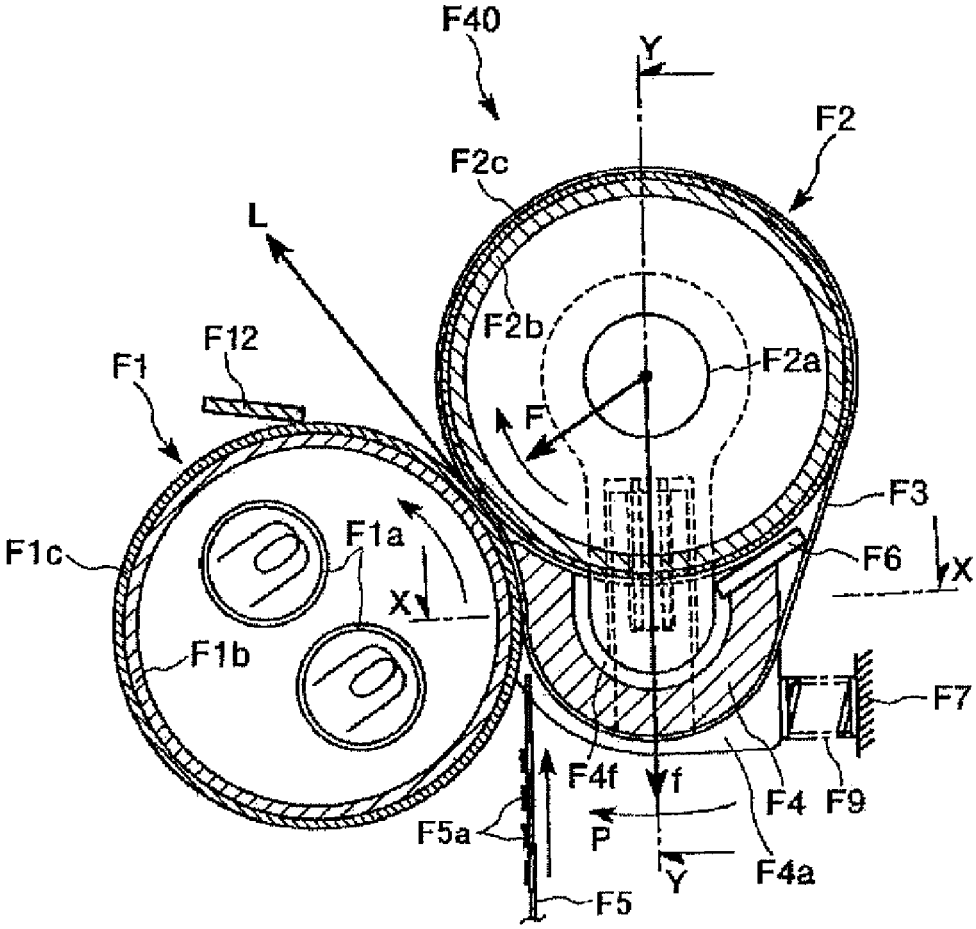
FIG. 4 is a cross-sectional view showing an example of a fixing device applied to the image forming device shown in FIG. 1.

FIG. 1 is a schematic diagram showing an example of the image forming device to which the liquid developer according to the embodiments of the invention is applied, FIG. 2 is an enlarged view enlargedly showing a part of the image forming device shown in FIG. 1, FIG. 3 is schematic diagram showing a condition of the toner particles in a liquid developer layer on a developing roller, and FIG. 4 is a cross-sectional view showing an example of a fixing device applied to the image forming device shown in FIG. 1.

As shown in FIGS. 1 and 2, an image forming device 1000 has four developing section 30Y, 30M, 30C, and 30K, an intermediate transfer section 40, a secondary transfer unit (secondary transfer section) 60, a fixing section (a fixing device) F40, and four liquid developer supply sections 80Y, 80M, 80C, and 80K.

The developing sections 30Y, 30M, and 30C have functions of developing latent images with a yellow liquid developer (Y), a magenta liquid developer (M), and a cyan liquid developer (C), respectively, to form monochroic images corresponding to the respective colors. Further, the developing section 30K has a function of developing the latent image with a black liquid developer (K), and forming a black monochroic image.

Since the configurations of the developing section 30Y, 30M, 30C, and 30K are the same, the developing section 30Y will hereinafter be explained.

As shown in FIG. 2, the developing section 30Y has a photoconductor 10Y as an example of an image carrying unit, a charging roller 11Y, an exposure unit 12Y, a developing unit 100Y, a photoconductor squeezing device 101Y, primary transfer backup roller 51Y, a neutralization unit 16Y, a photoconductor cleaning blade 17Y, and a developer recovery section 18Y along a rotational direction of the photoconductor 10Y.

The photoconductor 10Y has a base member having a cylindrical shape and a photoconductor layer formed on the outer peripheral surface thereof, and is capable of rotating around the center axis, and in the present embodiment, rotates clockwise as indicated by an arrow shown in FIG. 1.

The photoconductor 10Y is supplied with the liquid developer by the developing unit 100Y described later, and a layer of the liquid developer is formed on the surface thereof.

The charging roller 11Y is a device for charging the photoconductor 10Y, and the exposure unit 12Y is a device for irradiating the photoconductor with a laser beam there by forming a latent image on the photoconductor 10Y thus charged. The exposure unit 12Y includes a semiconductor laser, a polygon mirror, an F-θ lens, and so on, and irradiates the photoconductor 10Y with the laser beam modulated based on an image signal input from a host computer, not shown, such as a personal computer or a word processor.

The developing unit 100Y is a device for developing the latent image formed on the photoconductor 10Y using the liquid developer according to the embodiments of the invention. It should be noted that details of the developing unit 100Y will be described later.

The photoconductor squeezing device 101Y is disposed downstream of the developing unit 100Y in the rotational direction so as to be opposed to the photoconductor 10Y, and is composed mainly of a photoconductor squeezing roller 13Y, a cleaning blade 14Y pressed against and having slidable contact with the photoconductor squeezing roller 13Y for removing the liquid developer attached on the surface thereof, and a developer recovery section 15Y for recovering the liquid developer thus removed. The photoconductor squeezing device 101Y has a function of recovering superfluous carrier (the insulating liquid) and the toner, which is fundamentally unnecessary, from the developer developed on the photoconductor 10Y to increase the toner particle ratio in a visible image.

The primary transfer backup roller 51Y is a device for transferring the monochroic image formed on the photoconductor 10Y to the intermediate transfer section 40 described later.

The neutralization unit 16Y is a device for removing the residual charge on the photoconductor 10Y after the intermediate transfer image has been transferred on the intermediate transfer section 40 by the primary backup roller 51Y.

The photoconductor cleaning blade 17Y is a rubber member disposed so as to have contact with the surface of the photoconductor 10Y, and has a function of scraping off and removing the liquid developer remaining on the photoconductor 10Y after the image has been transferred on the intermediate transfer section 40 by the primary transfer backup roller 51Y.

The developer recovery section 18Y has a function of recovering the liquid developer removed by the photoconductor cleaning blade 17Y.

The intermediate transfer section 40 is an endless elastic belt member, wound around a belt drive roller 41 and a tension roller 42 so as to be stretched across these rollers, and rotationally driven by a drive roller 41 while having contact with the photo conductors 10Y, 10M, 10C, and 10K at the primary transfer backup rollers 51Y, 51M, 51C, and 51K, respectively.

The monochroic images corresponding to the respective colors formed by the developing sections 30Y, 30M, 30C, and 30K are sequentially transferred on the intermediate transfer section 40 by the primary transfer backup rollers 51Y, 51M, 51C, and 51K, respectively, and the monochroic images corresponding to the respective colors are overlapped with each other. Thus, a full color developer image (an intermediate transfer image) is formed on the intermediate transfer section 40.

As described above, the monochroic images formed on the plurality of photo conductors 10Y, 10M, 10C, and 10K are primarily transferred sequentially on the intermediate transfer section 40 to be carried in a overlapping manner, and then secondarily transferred on a recording medium F5 such as paper, a film, or cloth in a lump. Therefore, the elastic belt member is adopted as a measure for improving the secondary transfer characteristics by deforming itself along even a non-smooth surface of a sheet member made of fibers when transferring the toner image to the recording medium F5 in the secondary transfer process.

On the side of the tension roller 42 which applies tension to the intermediate transfer section 40 in cooperation with the belt drive roller 41, there is disposed a cleaning device composed mainly of an intermediate transfer section cleaning blade 46 and a developer recovery section 47.

The intermediate transfer section cleaning blade 46 has a function of scraping off and remove the liquid developer attached on the intermediate transfer section 40 after the image has been transferred on the recording medium F5 by the secondary transfer roller 61.

The developer recovery section 47 has a function of recovering the liquid developer removed by the intermediate transfer section cleaning blade 46.

Further, the intermediate transfer section squeezing device 52Y is disposed downstream of the first transfer backup roller 51Y along the moving direction of the intermediate transfer section 40.

The intermediate transfer section squeezing device 52Y is provided as a unit for removing superfluous insulating liquid from the transferred liquid developer in the case in which the liquid developer transferred on the intermediate transfer section 40 does not reach a desired dispersion condition.

The intermediate squeezing device 52Y is composed mainly of an intermediate transfer section squeezing roller 53Y, an intermediate transfer section squeezing backup roller 54Y disposed across the intermediate transfer section 40 from the intermediate transfer section squeezing roller 53Y, an intermediate transfer section squeezing cleaning blade 55Y pressed against and having contact with the intermediate transfer squeezing roller 53Y to clean the surface thereof, and a developer recovery section 15M.

The intermediate transfer section squeezing device 52Y has a function of recovering superfluous carrier from the developer primarily transferred on the intermediate transfer section 40 to increase the toner particle ratio in a visible image, and at the same time recovering the fog toner, which is fundamentally unnecessary. In the developer recovery section 15M, a recovery mechanism of the carrier recovered by the cleaning blade 14M for the photoconductor squeezing roller for magenta disposed on the downstream side along the moving direction of the intermediate transfer section 40 is used also for the intermediate transfer squeezing cleaning blade 55Y of the intermediate transfer squeezing roller 53Y. Accordingly, the developer recovering sections 15M, 15C and 15K (the developer recovering sections 15C and 15K are not shown in the drawings) of the image carrying member squeezing devices of the second or later colors in the moving direction of the intermediate transfer section 40 are used respectively as the developer recovering sections of the intermediate transfer section squeezing sections 52Y, 52M and 52C disposed in the downstream side of the preceding primary transfer backup rollers 51Y, 51M and 51C in the moving direction of the intermediate transfer section 40, thereby the intervals thereof can be maintained constant, and the structure can be simplified to achieve down sizing.

The secondary transfer unit 60 has a secondary transfer roller 61 disposed to face the belt driving roller 41 with the intermediate transfer section 40 intervening between them, and has a cleaning device composed mainly of a cleaning blade 62 for the secondary transfer roller 61 and a developer recovering section 63.

In the secondary transfer unit 60, the recording medium F5 is transported and fed in accordance with the timing when the intermediate transfer image formed by overlapping the monochroic images on the intermediate transfer section 40 reaches the transfer position of the secondary transfer unit 60, and thus the intermediate transfer image is secondarily transferred to the recording medium F5.

The toner image (transferred image) F5*a* thus transferred to the recording medium F5 in the secondary transfer unit 60 is transported to the fixing section F40 and fixed therein. The cleaning blade 62 has a function of scraping and removing the liquid developer attached to the secondary transfer roller 61 after transferring the image to the recording medium F5 with the secondary transfer roller 61.

The developer recovering section 63 has a function of recovering the liquid developer removed with the cleaning blade 62.

The developing units 100Y, 100M, 100C and 100K will be described in detail below. It should be noted that in the following explanation, the developing unit 100Y will be described as a representative example.

The developing unit 100Y has, as shown in FIG. 2, a liquid developer storing section 31Y, a coating roller 32Y, a restricting blade 33Y, a developer agitating roller 34Y, a developing roller 20Y, a developing roller cleaning blade 21Y and a developer compressing roller (compressing unit) 22Y.

The liquid developer storing section 31Y has a function of storing the liquid developer for developing a latent image formed on the photoconductor 10Y.

The coating roller 32Y has a function of feeding the liquid developer to the developing roller 20Y.

The coating roller 32Y is a so-called anilox roller, which is a metallic roller, such as an iron roller, having grooves formed uniformly and helically on the surface thereof and having been plated with nickel, and has a diameter of about 25mm. In this embodiment, plural grooves are formed slantwise with respect to the rotational direction of the coating roller 32Y by a so-called cutting process, a rolling process or the like. The coating roller 32Y is in contact with the liquid developer while rotating clockwise to retain the liquid developer stored in the liquid developer storing section 31Y in the grooves, and transports the retained liquid developer to the developing roller 20Y.

The restricting blade 33Y is in contact with the surface of the coating roller 32Y to restrict the amount of the liquid developer on the coating roller 32Y. Specifically, the restricting blade 33Y scrapes the excessive liquid developer on the coating roller 32Y to quantitate the liquid developer on the coating roller 32Y, which is to be fed to the developing roller 20Y. The restricting blade 33Y is formed of urethane rubber as an elastic material and supported with a restricting blade supporting member formed of a metal, such as iron. The restricting blade 33Y is provided on the side where the coating roller 32Y is rotated to come out from the liquid developer as viewed from the vertical plane A (i.e., on the left side as viewed from the vertical plane A in FIG. 2). It should be noted that the restricting blade 33Y has a rubber hardness of about 77 according to JIS-A, and the hardness of the restricting blade 33Y at the part in contact with the surface of the coating roller 32Y (about 77) is lower than the hardness of the developing roller 20Y described later at a part pressed against the surface of the coating roller 32Y (about 85). Further, the excessive liquid developer thus scraped is recovered to the liquid developer storing section 31Y for reuse.

The developer agitating roller 34Y has a function of agitating the liquid developer to form a uniformly dispersed state. By using the developer agitating roller 34Y, even in the case in which plural toner particles 1 are aggregated, the respective toner particles 1 can preferably be dispersed. In the case in which the liquid developer that has been once used is reused, in particular, the toner particles 1 can preferably be dispersed.

In the liquid developer storing section 31Y, the toner particles 1 in the liquid developer have positive charge, and the liquid developer in a uniformly dispersed state by agitating with the developer agitating roller 34Y is drawn up from the liquid developer storing section 31Y through rotation of the coating roller 32Y, and then fed to the developing roller 20Y after restricting the amount of the liquid developer with the restricting blade 33Y.

The developing roller 20Y retains the liquid developer and transports the liquid developer to the developing position facing the photoconductor 10Y for developing the latent image carried on the photoconductor 10Y with the liquid developer. The developing roller 20Y has a liquid developer layer 201Y formed on the surface thereof by feeding the liquid developer from the coating roller 32Y.

The developing roller 20Y has an inner core constituted by a metal, such as iron, having thereon an electro conductive elastic layer, and has a diameter of about 20 mm. Further, the elastic layer has a two-layer structure containing an urethane rubber layer having a rubber hardness of about 30 according to JIS-A and a thickness of about 5 mm as an inner layer, and an urethane rubber layer having a rubber hardness of about 85 according to JIS-A and a thickness of about 30 μm as a surface (outer) layer. The developing roller 20Y is pressed against the coating roller 32Y and the photoconductor 10Y at the surface layer as a contact part under pressure in an elastically deformed state.

Further, the developing roller 20Y is rotatable around the center axis thereof as the center, and the center axis is positioned downward with respect to the center rotation axis of the photoconductor 10Y. Further, the developing roller 20Y is rotated in the direction (i.e., the counterclockwise in FIG. 2) opposite to the rotational direction (i.e., the clockwise in FIG. 2) of the photoconductor 10Y. It should be noted that an electric field is formed between the developing roller 20Y and the photoconductor 10Y upon developing the latent image formed on the photoconductor 10Y.

The developer compressing roller 22Y is a device having a function of making the liquid developer retained by the developing roller 20Y into a compressed state. In other words, the developer compressing roller 22Y is a device having a function of applying an electric field having the same polarity as the toner particles 1 to the liquid developer layer 201Y, thereby localizing the toner particles 1 to the vicinity of the surface of the developing roller 20Y within the liquid developer layer 201Y as shown in FIG. 3. By localizing toner particles in this manner, the developing density (developing efficiency) can be improved, and as a result, a sharp image with high quality can be obtained.

A cleaning blade 23Y is provided on the developer compressing roller 22Y.

The cleaning blade 23Y has a function of removing the liquid developer attached to the developer compressing roller 22Y. The liquid developer removed with the cleaning blade 23Y is recovered into the liquid developer storing section 31Y for reuse.

Further, the developing unit 100Y has a developing roller cleaning blade 21Y made of rubber in contact with the surface of the developing roller 20Y. The developing roller cleaning blade 21Y is a device for scraping and removing the liquid developer remaining on the developing roller 20Y after completing development at the developing position. The liquid developer removed by the developing roller cleaning blade 21Y is recovered into the liquid developer storing section 31Y for reuse.

Further, the image forming apparatus 1000 has, as shown in FIGS. 1 and 2, four liquid developer feeding sections 80Y, 80M, 80C and 80K for feeding the liquid developer to the developing sections 30Y, 30M, 30C and 30K. The liquid developer feeding sections 80Y, 80M, 80C and 80K have the same configurations, and therefore, the liquid developer feeding section 80Y will hereinafter be explained.

The liquid developer feeding section 80Y has a recovered liquid developer storing section 81Y, a replenishing liquid developer storing section 82Y, transporting devices 83Y and 84Y, a pump 85Y and a filter 86Y.

The recovered liquid developer storing section 81Y mainly stores the recovered liquid developer recovered by the developer recovering section 18Y, and the recovered liquid developer is fed to the liquid developer storing section 31Y of the developing section 30Y with the transporting device 83Y. Further, the replenishing liquid developer storing section 82Y stores the liquid developer, and the liquid developer is fed to the liquid developer storing section 31Y with the transporting device 84Y. The formulations of the liquid developer stored in the replenishing liquid developer storing section 82Y and the recovered liquid developer stored in the recovered liquid developer storing section 81Y can be the same as or different from that of the liquid developer stored in the liquid developer storing section 31Y.

Further, the liquid developer recovered to the developer recovering section 18Y is fed to the liquid developer feeding section 80Y through a transporting path 70Y.

Further, a pump 85Y is provided on the transporting path 70Y, and the liquid developer recovered to the developer recovering section 18Y is transported to the recovered liquid developer storing section 81Y with the pump 85Y.

Further, a filter 86Y is provided on the transporting path 70Y, with which coarse particles, foreign matters and the like can be removed from the recovered liquid developer. The solid contents including coarse particles, foreign matters and the like thus removed with the filter 85Y are detected with a detecting unit, not shown, for detecting the state of the filter. Further, the filter 86Y is replaced based on the detection result thereof. Thus, the filtering function of the filter 86Y can stably be maintained.

Then, the fixing section will be explained.

The fixing section F40 fixes an unfixed toner image F5*a* formed in the developing section, the transfer section and so on, on the recording medium F5.

As shown in FIG. 4, the fixing section F40 has a thermal fixing roller F1, a pressure roller F2, a heat resistant belt F3, a belt stretching member F4, a cleaning member F6, a frame F7 and a spring F9.

The thermal fixing roller (fixing roller) F1 has a roller substrate F1*b* constituted by a tubular member, an elastic member F1*c* covering the outer periphery of the roller substrate F1*b*, and columnar halogen lamps F1*a* as a heat source disposed inside the roller substrate F1*b*, and is rotatable counterclockwise as indicated by the arrow in the drawing.

Two columnar halogen lamps F1*a*, F1*a* constituting a heat source are installed inside the thermal fixing roller F1, and heating elements of the columnar halogen lamps F1*a*, F1*a* are disposed at positions different from each other. Further, the columnar halogen lamps F1*a*, F1*a* are selectively turned on, whereby the temperature is easily controlled under different conditions including the fixing nip position where the heat resistant belt F3 described later is wound on the thermal fixing roller F1 and the position where the belt stretching member F4 described later is in contact with the thermal fixing roller F1, and under different conditions including a recording medium having a large width and a recording medium having a small width.

The pressure roller F2 is disposed to face the thermal fixing roller F1 and applies pressure to the recording medium F5 provided with an unfixed toner image F5*a*, via the heat resistant belt F3 described later.

Further, the pressure roller F2 has roller substrate F2*b* constituted by a tubular member, and an elastic member F2*c* covering the outer periphery of the roller substrate F2*b*, and is rotatable clockwise as indicated by the arrow in the drawing.

Further, a PFA layer is provided as a surface layer of the elastic member F1*c* of the thermal fixing roller F1. Thus, the elastic members F1*c* and F2*c* undergo elastic deformation in substantially the same manner to form a so-called horizontal nip, although the elastic members F1*c* and F2*c* are different from each other in thickness, and no difference is formed in conveying speed between the peripheral speed of the thermal fixing roller F1 and the speed of the heat resistant belt F3 or the recording medium F5 described later, whereby the image fixing operation can be carried out considerably stably.

The heat resistant belt F3 is an endless loop belt that is movably stretched on the outer peripheries of the pressure roller F2 and the stretching member F4 and held under pressure between the thermal fixing roller F1 and the pressure roller F2.

The heat resistant belt F3 has a thickness of 0.03 mm or larger and is formed of a seamless tube having a two-layer structure composed of a front surface (i.e., the side in contact with the recording medium F5) formed of PFA and a back surface (i.e., the side in contact with the pressure roller F2 and the belt stretching member F4) made of polyimide. It should be noted that the heat resistant belt F3 is not limited thereto and can also be formed of other materials, such as a metal tube, such as a stainless steel tube and a nickel electro formed tube, and a heat resistant resin tube, such as a silicone tube.

The belt stretching member F4 is disposed on the upstream side of the fixing nip section of the thermal fixing roller F1 and the pressure roller F2 in the conveying direction of the recording medium F5 oscillatable in the direction indicated by the arrow P using the rotation axis F2*a* of the pressure roller F2 as the center.

The belt stretching member F4 stretches the heat resistant belt F3 in the tangential direction of the thermal fixing roller F1 under the condition in which the recording medium F5 does not passthrough the fixing nip section. Although there are some cases in which the recording medium F5 is not smoothly inserted to the fixing nip section and is wrinkled at the edge thereof upon fixing, in the case in which the fixing pressure is too large at the initial position, at which the recording medium F5 is inserted to the fixing nip section, by stretching the heat resistant belt F3 in the tangential direction of the thermal fixing roller F1, an introducing port, to which the recording medium F5 can be smoothly inserted, can be formed, whereby the recording medium F5 can be stably inserted to the fixing nip section.

The belt stretching member F4 is a belt sliding member having a substantially semi lunar shape that is interfit inside the heat resistant belt F3 and applies a tension f to the heat resistant belt F3 in cooperation with the pressure roller F2 (the heat resistant belt F3 slides on the belt stretching member F4). The belt stretching member F4 is disposed at such a position that the nip section is formed by winding the heat resistant belt F3 thereon on the side of the heat fixing roller F1 with respect to the tangential direction L of the contact part under pressure of the heat fixing roller F1 and the pressure roller F2. A projected wall F4*a* is provided as being protruded from one end or both ends in the axial direction of the belt stretching member F4, and in the case in which the heat resistant belt F3 is deviated toward one side in the axial direction, the deviation of the heat resistant belt F3 is regulated by making the heat resistant belt F3 in contact with the projected wall F4*a*. A spring F9 is provided in a compressed state between the side of the projected wall F4*a* opposite to the thermal fixing roller F1 and the frame F7 to press lightly the projected wall F4*a* of the belt stretching member F4 onto the thermal fixing roller F1, whereby the belt stretching member F4 is in contact under sliding with the thermal fixing roller F1 for positioning.

The position where the belt stretching member F4 is lightly pressed onto the thermal fixing roller F1 forms the nip initial position, and the position where the pressure roller F2 is pressed onto the thermal fixing roller F1 forms the nip terminal position.

In the fixing section F40, the recording medium F5 having an unfixed toner image F5*a* formed thereon is inserted to the fixing nip section from the nip initial position, and then it passes between the heat resistant belt F3 and the thermal fixing roller F1 and exits from the nip terminal position, whereby the unfixed toner image F5*a* formed on the recording medium F5 is fixed. Subsequently, the recording medium F5 is discharged in the tangential direction L of the contact part under pressure of the thermal fixing roller F1 and the pressure roller F2.

The cleaning member F6 is disposed between the pressure roller F2 and the belt stretching member F4.

The cleaning member F6 is in contact under sliding with the inner surface of the heat resistant belt F3 to clean foreign matters and abrasion powder on the inner surface of the heat resistant belt F3. The heat resistant belt F3 is refreshed by cleaning foreign matters and abrasion powder to reduce the destabilizing factor on friction coefficient described above. Further, a concave portion F4*f* is provided on the belt stretching member F4 for housing the foreign matters and abrasion powder removed from the heat resistant belt F3.

The fixing section F40 has a removing blade (removing unit) F12 that removes the insulating liquid attached to (remaining on) the surface of the thermal fixing roller F1 after fixing the toner image F5*a* to the recording medium F5. The removing blade F12 removes the insulating liquid and simultaneously can remove the toner and the like transferred to the thermal fixing roller F1 upon fixing.

For stably driving the heat resistant belt F3, which is stretched on the pressure roller P2 and the belt stretching member F4, with the pressure roller F2, the friction coefficient between the pressure roller F2 and the heat resistant belt F3 may be set larger than the friction coefficient between the belt stretching member F4 and the heat resistant belt F3. However, there are some cases in which the friction coefficient is destabilized due to insertion of foreign matters between the heat resistant belt F3 and the pressure roller F2 or the heat resistant belt F3 and the belt stretching member F4, or abrasion at the contact part of the heat resistant belt F3 with the pressure roller F2 or the belt stretching member F4.

Therefore, the winding angle of the heat resistant belt F3 on the belt stretching member F4 is set smaller than the winding angle of the heat resistant belt F3 on the pressure roller F2, and the diameter of the belt stretching member F4 is set smaller than the diameter of the pressure roller F2. Thus, the length where the heat resistant belt F3 is in contact under sliding on the belt stretching member F4 is short to avoid the destabilizing factors due to time-lapse deterioration and external disturbance, whereby the heat resistant belt F3 can be stably driven with the pressure roller F2.

The heat applied by the thermal fixing roller F1 (fixing temperature) is preferably from 80 to 200° C., more preferably from 100 to 180° C., and further preferably from 100 to 150° C. Since the liquid developer of the embodiment of the invention is superior in fixing property at a low temperature, a toner image can be firmly fixed to a recording medium even at the relatively low fixing temperature.

Although the invention has been hereinabove described with reference to the preferred embodiments, the invention is not construed as being limited thereto.

For example, the liquid developer according to an embodiment of the invention is not limited to one applied to the image forming apparatus described above.

Further, the liquid developer according to the embodiments of the invention is not limited to those obtained in the manufacturing methods described above. For example, although the resin dispersion liquid in the embodiment is prepared by using the pulverized substance, which is manufactured by kneading and pulverizing the colorant and the resin material, the resin dispersion liquid may not be manufactured with a pulverized substance and may be obtained, for example, by directly mixing the insulating liquid, the colorant and the resin material. Further, a kneaded substance obtained by kneading the colorant and the resin material along with the liquid constituting the insulating liquid may be coarsely ground, and then the pulverized substance thus obtained may be pulverized and dispersed in the insulating liquid to form a liquid developer. The toner particles can certainly contain the insulating liquid inside according to such a method.

EXAMPLES

Production of Liquid Developer

Example 1

Preparation of Colorant Master (Kneading Step and Pulverizing Step)

Firstly, a mixture of 40 parts by weight of an ethylene-methacrylic acid copolymer (melting point Tm: 98° C., Vicat softening point Tv: 78° C., modulus of flexural rigidity: 110 MPa, Nucrel N410, a trade name, produced by Du Pont-Mitsui Polychemicals Co., Ltd.) as a resin material, 50 parts by weight of a cyan pigment (Pigment Blue 15:3, produced by Dainichiseika Color & Chemicals Mfg. Co., Ltd.) as a colorant, and 10 parts by weight of a dispersant (Ajisper PB821, a trade name, produced by Ajinomoto Co., Inc.) was prepared. The components were mixed with a 20-L Henschel mixer to provide a raw material for a colorant master.

Subsequently, the raw material was kneaded with a biaxial kneader/extruder heated to 120° C. to provide a kneaded substance. Then, the kneaded substance extruded from the extrusion port of the biaxial kneader/extruder was cooled (kneading process).

The kneaded substance thus cooled was coarsely pulverized to form powder having an average particle diameter of 2.0 mm or less, thus a colorant master (pulverized substance) was obtained. A hammer mill was used for coarse pulverization of the kneaded substance (pulverizing process).

Resin Swelling Liquid Preparing Step

Subsequently, 50 parts by weight of the resulting colorant master (pulverized substance), 50 parts by weight of an ethylene-methacrylic acid copolymer (Nucrel N410, a trade name, produced by Du Pont-Mitsui Polychemicals Co., Ltd.) as an additional resin material, and 100 parts by weight of soybean oil (soybean refined oil, produced by J-Oil Mills, Inc.) were placed in a high-speed agitating machine having two rotary blades (T. K. Hivis Mix Model 2P-03, produced by Primix Corp.). In the high-speed agitating machine used in this example, two rotary blades were in planetary motion, namely in orbital motion and rotation by itself simultaneously. While the high-speed agitating machine was operated for agitation at an orbital revolution number of 90 rpm and a self-rotation number of 220 rpm, the temperature was increased from room temperature (20° C.) to 120° C. over 1.5 hours. The content of the agitating machine became a viscous liquid of the resin having been swollen and softened. Thereafter, the content was agitated under the same conditions at 120° C. for 0.5 hour, and 300 parts by weight of soybean oil (soybean refined oil, produced by J-Oil Mills, Inc.) was then added to the agitating machine, followed by further agitating continuously under the same conditions for 0.5 hour, so as to provide a resin swelling liquid.

Resin Depositing Step

After the rotation number of the high-speed agitating machine having the resulting resin swelling liquid charged therein was controlled to an orbital revolution number of 50 rpm and a self-rotation number of 100 rpm, the temperature was decreased from 120° C. to 80° C. at a cooling rate of −25° C. per hour, and then decreased from 80° C. to 55° C. at a cooling rate of −5° C. per hour. Upon cooling the resin swelling liquid, it was confirmed that the resin material was deposited at a temperature in a range of from 75 to 60° C. Thereafter, the temperature was decreased from 55° C. to room temperature (20° C.) at a cooling rate of −25° C. per hour to provide a resin fine particle dispersion liquid having resin fine particles (toner particles) dispersed in an insulating liquid (soybean oil).

Subsequently, 5 parts by weight of zirconium octoate (Octope Zr, produced by Hope Chemical Co., Ltd.) as a charge controlling agent and 2 parts by weight of a polyamine fatty acid polymer (Solsperse 11200, produced by Lubrizol Corp. Japan) as a dispersant were added to the resulting resin fine particle dispersion liquid charged in the high-speed agitating machine, and the mixture was agitated at an orbital revolution number of 50 rpm and a self-rotation number of 100 rpm to provide a cyan liquid developer. The average particle diameter by volume of the resin fine particles was measured with Mastersizer 2000 (produced by Malvern Instruments, Ltd.). The average particle diameter was 1.9 μm, and the amount of coarse particles having a diameter exceeding 5 μm was less than 1% by volume. The resulting liquid developer was filtered, and the toner particles were measured for melting point. The melting point was 90° C., which was lower than the melting point (98° C.) of the used resin material (ethylene-methacrylic acid copolymer). It is considered that this is because the soybean oil remains among the molecular chains of the resin material (ethylene-methacrylic acid copolymer) constituting the toner particles to plasticize the resin. It should be noted that the melting point was measured according to JIS K7121 1987.

Example 2

Preparation of Colorant Master (Kneading Step and Pulverizing Step)

Firstly, a mixture of 40 parts by weight of an ethylene-methacrylic acid copolymer (melting point Tm: 93° C., Vicat softening point Tv: 63° C., modulus of flexural rigidity: 83 MPa, Nucrel N1525, a trade name, produced by Du Pont-Mitsui Polychemicals Co., Ltd.) as a resin material, 50 parts by weight of a cyan pigment (Pigment Blue 15:3, produced by Dainichiseika Color & Chemicals Mfg. Co., Ltd.) as a colorant, and 10 parts by weight of a dispersant (Ajisper PB821, a trade name, produced by Ajinomoto Co., Inc.) was prepared. The components were mixed with a 20-L Henschel mixer to provide a raw material for a colorant master.

Subsequently, the raw material was kneaded with a biaxial kneader/extruder heated to 120° C. to provide a kneaded substance. The kneaded substance extruded from the extrusion port of the biaxial kneader/extruder was cooled (kneading process).

The kneaded substance thus cooled was coarsely pulverized to form powder having an average particle diameter of 2.0 mm or less, thus a colorant master (pulverized substance) was obtained. A hammer mill was used for coarse pulverization of the kneaded substance (pulverizing process).

Resin Solution Preparing Step

Subsequently, 50 parts by weight of the resulting colorant master (pulverized substance), 50 parts by weight of an ethylene-methacrylic acid copolymer (Nucrel N1525, a trade name, produced by Du Pont-Mitsui Polychemicals Co., Ltd.) as an additional resin material, and 100 parts by weight of high oleic (HO) rapeseed oil (Canola Oil, a trade name, produced by The Nisshin OilliO Group, Ltd.) as the first liquid were agitated and mixed in a stainless container by a homogenizer (produced by Microtec Co., Ltd.) at a revolution speed of 8000 rpm while heating until the material temperature reached 120° C.

After the material temperature reached 120° C., the mixture was further agitated continuously with the homogenizer at a revolution speed of 8000 rpm for 30 minutes while keeping the temperature constant to obtain a resin solution. It should be noted that the pigment was micro-dispersed evenly in the resin solution.

Resin Depositing Step

Subsequently, heating of the resulting resin solution was stopped, and deposition of the resin fine particles (the toner particles) was executed while agitating in the same conditions, thus the resin fine particle dispersion liquid having the colored resin fine particles (the toner particles) dispersed therein was obtained. As the second liquid, 300 parts by weight of the aliphatic hydrocarbon (Cosmo SP-10, a trade name, produced by Cosmo Oil Lubricants Co., Ltd.) was used. The deposition of the resin fine particles was executed by agitating the resin solution while dropping the aliphatic hydrocarbon at room temperature, and cooling the resin solution gradually until the temperature of the resin solution reached room temperature.

Subsequently, 5 parts by weight of zirconium octoate (Octope Zr, produced by Hope Chemical Co., Ltd.) as a charge controlling agent and 2 parts by weight of a polyamine fatty acid polymer (Solsperse 11200, a tradename, produced by lubrizol Corp. Japan) as a dispersant were added to the resulting resin fine particle dispersion liquid while agitating the liquid to obtain a cyan liquid developer. The average particle diameter by volume of the resin fine particles was measured with Mastersizer 2000 (produced by Malvern Instruments, Ltd.). The average particle diameter was 2.5 μm, and the amount of coarse particles having a diameter exceeding 5 μm was less than 1% by volume. The resulting liquid developer was filtered, and the toner particles were measured for melting point. The melting point was 84° C., which was lower than the melting point (93° C.) of the used resin material (ethylene-methacrylic acid copolymer). It is considered that this is because the HO rapeseed oil remains among the molecular chains of the resin material (ethylene-methacrylic acid copolymer) constituting the toner particles to plasticize the resin. It should be noted that the melting point was measured according to JIS K7121 1987.

Example 3

Firstly, 40 parts by weight of an ethylene-methacrylic acid copolymer (melting point Tm: 95° C., Vicat softening point Tv: 67° C., modulus of flexural rigidity: 65 MPa, Nucrel AN42115C, a trade name, produced by Du Pont-Mitsui Polychemicals Co., Ltd.) as a resin material, 50 parts by weight of a cyan pigment (Pigment Blue 15:3, produced by Dainichiseika Color & Chemicals Mfg. Co., Ltd.) as a colorant, 10 parts by weight of soybean oil (soybean refined oil, produced by J-Oil Mills, Inc.), and 10 parts by weight of a dispersant (Ajisper PB821, a trade name, produced by Ajinomoto Co., Inc.) were prepared. The components we remixed with a 20-L Henschel mixer to provide a raw material for a colorant master.

Subsequently, the raw material was kneaded with a biaxial kneader/extruder heated to 120° C. to provide a kneaded substance. Then, the kneaded substance extruded from the extrusion port of the biaxial kneader/extruder was cooled.

The kneaded substance thus cooled was coarsely pulverized to form powder having an average particle diameter of 2.0 mm or less, thus a colorant master (pulverized substance) was obtained. A hammer mill was used for coarse pulverization of the kneaded substance.

Subsequently, 50 parts by weight of the pulverized substance thus obtained and 50 parts by weight of an ethylene-methacrylic acid copolymer (Nucrel AN42115C, a trade name, produced by Du Pont-Mitsui Polychemicals Co., Ltd.) were kneaded with a biaxial kneader/extruder heated to 120° C., and then cooled and coarsely pulverized to provide a colored raw material in a powder form having an average particle diameter of 1.0 mm or less.

Subsequently, 20 parts by weight of the colored raw material, 80 parts by weight of an aliphatic hydrocarbon (Cosmo SP-10, produced by Cosmo Oil Lubricants Co., Ltd.) as an insulating liquid, 1 part by weight of zirconium octoate (Octope Zr, produced by Hope Chemical Co., Ltd.) as a charge controlling agent, and 1 parts by weight of a polyamine fatty acid polymer (Solsperse 11200, produced by Lubrizol Corp. Japan) as a dispersant were placed in a planetary ball mill (Planet H, produced by Gokin Planetaring, Inc.), to which zirconia balls having a diameter 1 mm were further added, and the colored raw material was pulverized and dispersed for 24 hours. Thus, a liquid developer was obtained. Further, the average particle diameter by volume of the resin fine particles was measured with Mastersizer 2000 (produced by Malvern Instruments, Ltd.). The average particle diameter was 2.8 μm, and the amount of coarse particles having a diameter exceeding 5 μm was 10% by volume. Further, the resulting liquid developer was filtered, and the toner particles were measured for melting point. The melting point was 90° C., which was lower than the melting point (95° C.) of the used resin material (ethylene-methacrylic acid copolymer). It is considered that this is because the soybean oil remains among the molecular chains of the resin material (ethylene-methacrylic acid copolymer) constituting the toner particles to plasticize the resin. It should be noted that the melting point was measured according to JIS K7121 1987.

Example 4

The liquid developer was manufactured in the same manner as in Example 3 except the fact that the kinds of the resin material and the insulating liquid used actually were changed as shown in Table 1.

Example 5

The liquid developer was manufactured in the same manner as in Example 1 except the fact that the kind of the resin material used actually was changed as shown in Table 1.

Example 6

The liquid developer was manufactured in the same manner as in Example 2 except the fact that the kind of the resin material used actually was changed as shown in Table 1.

Example 7

Firstly, 40 parts by weight of an ethylene-methacrylic acid copolymer (melting point Tm: 95° C., Vicat softening point Tv: 67° C., modulus of flexural rigidity: 65 MPa, Nucrel AN42115C, a trade name, produced by Du Pont-Mitsui Polychemicals Co., Ltd.) as a resin material, 50 parts by weight of a cyan pigment (Pigment Blue 15:3, produced by Dainichiseika Color & Chemicals Mfg. Co., Ltd.) as a colorant, and 10 parts by weight of a dispersant (Ajisper PB821, a trade name, produced by Ajinomoto Co., Inc.) were prepared. The components were mixed with a 20-L Henschel mixer to provide a raw material for a colorant master.

Subsequently, the raw material was kneaded with a biaxial kneader/extruder heated to 120° C. to provide a kneaded substance. Then, the kneaded substance extruded from the extrusion port of the biaxial kneader/extruder was cooled.

The kneaded substance thus cooled was coarsely pulverized to form powder having an average particle diameter of 2.0 mm or less, thus a colorant master (pulverized substance) was obtained. A hammer mill was used for coarse pulverization of the kneaded substance.

Subsequently, 50 parts by weight of the pulverized substance thus obtained and 50 parts by weight of an ethylene-methacrylic acid copolymer (Nucrel AN42115C, a trade name, produced by Du Pont-Mitsui Polychemicals Co., Ltd.) were kneaded with a biaxial kneader/extruder heated to 120° C., and then cooled and coarsely pulverized to provide a colored raw material in a powder form having an average particle diameter of 1.0 mm or less.

Subsequently, 20 parts by weight of the colored raw material, 50 parts by weight of soybean oil (soybean refined oil, produced by J-Oil Mills, Inc.) as an insulating liquid, 30 parts by weight of methyl myristate (Paster M-14, a trade name, produced by Lion Corp.), 1 part by weight of zirconium octoate (Octope Zr, a trade name, produced by Hope Chemical Co., Ltd.) as a charge controlling agent, and 1 parts by weight of a polyamine fatty acid polymer (Solsperse 11200, a trade name, produced by Lubrizol Corp. Japan) as a dispersant were placed in a planetary ball mill (Planet H, produced by Gokin Planetaring, Inc.), to which zirconia balls having a diameter 1mm were further added, and the colored raw material was pulverized and dispersed for 24 hours. Thus, a liquid developer was obtained. Further, the average particle diameter by volume of the resin fine particles was measured with Mastersizer 2000 (produced by Malvern Instruments, Ltd.). The average particle diameter was 2.8 μm, and the amount of coarse particles having a diameter exceeding 5 μm was 15% by volume. Further, the resulting liquid developer was filtered, and the toner particles were measured for melting point. The melting point was 92° C., which was lower than the melting point (95° C.) of the used resin material (ethylene-methacrylic acid copolymer). It should be noted that the melting point was measured according to JIS K7121 1987.

Example 8

The liquid medium was manufactured in the same manner as in Example 7 except the fact that a nonvolatile petroleum ester (aniline point: −10° C., Prifer 6813, produced by UNIQEMA) was used instead of methyl myristate.

Example 9

The liquid developer was manufactured in the same manner as in Example 8 except the fact that the kinds of the resin material and the insulating liquid used actually were changed as shown in Table 1.

Comparative Example 1

The liquid developer was manufactured in the same manner as in Example 1 except the fact that the resin material used actually was changed from the ethylene-methacrylic acid copolymer to a polyester resin (glass transition temperature Tg: 47° C., melting point Tm. 94° C.). The toner particles in the liquid developer thus obtained had a particle diameter that was substantially the same as the particle diameter of the pulverized substance prior to the resin swelling liquid preparation process, and thus no pulverization proceeded.

Comparative Example 2

Firstly, a mixture of 40 parts by weight of a polyester resin (glass transition temperature Tg: 47° C., melting point Tm: 94° C.) as a resin material, 50 parts by weight of a cyan pigment (Pigment Blue 15:3, produced by Dainichiseika Color & Chemicals Mfg. Co., Ltd.) as a colorant, and 10 parts by weight of a dispersant (Ajisper PB821, a trade name, produced by Ajinomoto Co., Inc.) was prepared. The components we remixed with a 20-L Henschel mixer to provide a raw material for a colorant master.

Subsequently, the raw material was kneaded with a biaxial kneader/extruder heated to 120 C. to provide a kneaded substance. Then, the kneaded substance extruded from the extrusion port of the biaxial kneader/extruder was cooled.

The kneaded substance thus cooled was coarsely pulverized to form powder having an average particle diameter of 1.0 mm or less, thus a colorant master (pulverized substance) was obtained. A hammer mill was used for coarse pulverization of the kneaded substance.

Subsequently, 50 parts by weight of the pulverized substance thus obtained and 50 parts by weight of a polyester resin (glass transition temperature Tg: 47° C., melting point Tm: 90° C.) were kneaded with a biaxial kneader/extruder heated to 120° C., and then cooled and coarsely pulverized to provide a colored raw material in a powder form having an average particle diameter of 1.0 mm or less.

Subsequently, 20 parts by weight of the colored raw material, 80 parts by weight of an aliphatic hydrocarbon (Cosmo SP-10, produced by Cosmo Oil Lubricants Co., Ltd.) as an insulating liquid, 1 part by weight of zirconium octoate (Octope Zr, produced by Hope Chemical Co., Ltd.) as a charge controlling agent, and 2 parts by weight of a polyamine fatty acid polymer (Solsperse 11200, a trade name, produced by Lubrizol Corp. Japan) as a dispersant were placed in a planetary ball mill (Planet H. produced by Gokin Planetaring, Inc.), to which zirconia balls having a diameter 1mm were further added, and the colored raw material was pulverized and dispersed for 24 hours. Thus, a liquid developer was obtained. Further, the average particle diameter by volume of the resin fine particles was measured with Mastersizer 2000 (produced by Malvern Instruments, Ltd.). The average particle diameter was 3.8 μm, and the amount of coarse particles having a diameter exceeding 5 μm was 10% by volume. Further, the resulting liquid developer was filtered, and the toner particles were measured for melting point. The melting point was 94° C., which was the same as the melting point of the resin material used (polyester resin) It should be noted that the melting point was measured according to JIS K7121 1987.

Comparative Example 3

The liquid developer was manufactured in the same manner as in Comparative example 2 except the fact that as the insulating liquid, high oleic (HO) rapeseed oil (Canola Oil, a trade name, produced by The Nisshin OilliO Group, Ltd.) was used instead of the aliphatic hydrocarbon. The toner particles in the liquid developer thus obtained had a particle diameter that was substantially the same as the particle diameter of the colored raw material before pulverizing with the planetary ball mill, and thus no pulverization proceeded.

Comparative Example 4

The liquid developer was manufactured in the same manner as in Comparative example 2 except that an ethylene-methacrylic acid copolymer (melting point Tm: 95° C., Vicat softening point Tv: 67° C., modulus of flexural rigidity: 65 MPa, Nucrel AN42115C, a trade name, produced by Du Pont-Mitsui Polychemicals Co., Ltd.) was used instead of the polyester resin.

The resin materials and the insulating liquids used for producing the liquid developers, the liquids confirmed as the liquid component contained in the toner particles by the gas chromatography method described later, and the melting points of the toner particles of Examples and Comparative Examples are shown in Table 1 below. It should be noted that the content of acid in the resin material in Table 1 denotes a weight ratio of a monomer component, which has a carboxylic acid as a functional group, included in the resin material calculated from the content of the carboxylic acid included in the resin material measured the FT-IR method.

Further, in Table 1, an ethylene-methacrylic acid copolymer is described as EMAA, an ethylene-vinyl acetate copolymer (melting point Tm: 89° C., Vicat softening point Tv: 62° C., modulus of flexural rigidity: 51 MPa, Evaflex EV550, a trade name, produced by Du Pont-Mitsui Polychemicals Co., Ltd.) is described as EVA, and polyester resin is described as PEs. Further, a nonvolatile petroleum ester (aniline point: −15° C., DBE, a tradename, produced by INVISTA (Japan) K. K) is described as DBE. Further, in the Table, HO rapeseed oil denotes high oleic rapeseed oil (Canola Oil, a trade name, produced by The Nisshin OilliO Group, Ltd.), HL safflower oil denotes high linoleic safflower oil (produced by Summit Oil Mill Co., Ltd.). Further, in the column of the contents of the constitutional components of the liquid developers, the contents in the liquid developers are shown. It should be noted that all of the liquids (insulating liquids) used in Examples and Comparative examples had an initial boiling point of 140° C. or higher measured according to JIS K2254.

Further, in Table 1, the melting point of the resin material measured according to JIS K7121 1987 is represented by Tm (° C.). Still further, in the column of "Vicat softening point" in the table, the Vicat softening point Tv (° C.) measured according to JIS K7026 1999 is shown for the other resin materials than the polyester resin, and the glass transition temperature Tg (° C.) measured according to JIS K7121 is shown for the polyester resin.

Further, a part of each of the liquid developers of Examples and Comparative Examples was collected, from which a cake (toner particles) was separated by centrifugation. The liquid component contained in the solid content was extracted and then quantitatively analyzed by a gas chromatography method. As a result, it was confirmed that in Examples 1 through 9, the insulating liquid constituting the liquid developer of each of the examples was included in the corresponding toner particles.

TABLE 1

| | Resin material | | | | | | | Insulating liquid | | | | Toner particles | |
|---|---|---|---|---|---|---|---|---|---|---|---|---|---|
| | Kind | Acid content (Wt %) | Vicat softening point Tv (° C.) | Melting point Tm (° C.) | Tm − Tv (° C.) | Modulus of flexural rigidity (MPa) | Content (Wt %) | Kind | Content (Wt %) | Kind | Content (Wt %) | Liquid component contained | Melting point (° C.) |
| Example 1 | EMAA | 9 | 78 | 98 | 20 | 110 | 13.8 | soybean oil | 78.9 | — | — | soybean oil | 90 |
| Example 2 | EMAA | 15 | 63 | 93 | 30 | 83 | 13.8 | HO rapeseed oil | 19.7 | Cosmo SP-10 | 59.2 | HO rapeseed oil | 84 |
| Example 3 | EMAA | 5 | 67 | 95 | 28 | 65 | 13.4 | soybean oil | 0.9 | Cosmo SP-10 | 78.4 | soybean oil | 90 |
| Example 4 | EVA | 0 | 62 | 89 | 27 | 51 | 13.4 | HL safflower oil | 0.9 | Cosmo SP-10 | 78.4 | HL safflower oil | 82 |
| Example 5 | EMAA | 9 | 82 | 99 | 17 | 140 | 13.8 | soybean oil | 78.9 | — | — | soybean oil | 91 |
| Example 6 | EMAA | 10 | 62 | 95 | 33 | 79 | 13.8 | HO rapeseed oil | 19.7 | Cosmo SP-10 | 59.2 | HO rapeseed oil | 86 |
| Example 7 | EMAA | 5 | 67 | 95 | 28 | 65 | 13.7 | soybean oil | 49.0 | methyl myristate | 29.4 | methyl myristate | 92 |
| Example 8 | EMAA | 5 | 67 | 95 | 28 | 65 | 13.7 | soybean oil | 49.0 | Prifer6813 | 29.4 | Prifer6813 | 89 |
| Example 9 | EVA | 0 | 62 | 89 | 27 | 51 | 13.7 | soybean oil | 49.0 | DBE | 29.4 | DBE | 80 |
| Comparative Example 1 | PEs | 0 | 47 (Tg) | 94 | — | — | 13.6 | soybean oil | 78.9 | — | — | — | 94 |
| Comparative Example 2 | PEs | 0 | 47 (Tg) | 94 | — | — | 13.4 | Cosmo SP-10 | 77.7 | — | — | — | 94 |
| Comparative Example 3 | PEs | 0 | 47 (Tg) | 94 | — | — | 13.4 | HO rapeseed oil | 77.7 | — | — | — | 94 |
| Comparative Example 4 | EMAA | 5 | 67 | 95 | 28 | 65 | 13.4 | Cosmo SP-10 | 77.7 | — | — | — | 95 |

2. Evaluation

The liquid developers thus obtained were evaluated in the following manner.

2-1. Storage Stability

The liquid developers obtained in Examples and Comparative Examples were allowed to stand under an environment at a temperature of from 15 to 25° C. for 6 months Thereafter, the state of the toner contained in the liquid developer was visually observed and evaluated based on the following five grades.

A: Completely no floatage or precipitation due to aggregation of toner particles found B: Substantially no floatage or precipitation due to aggregation of toner particles found C: Slight floatage and precipitation due to aggregation of toner particles found without problem upon using as liquid developer D: Floatage and precipitation due to aggregation of toner particles clearly found E: Floatage and precipitation due to aggregation of toner particles considerably found 2-2. Environmental Stability of Liquid Developer (Long-term Stability)

The liquid developers obtained in Examples and Comparative Examples were allowed to stand under an environment at a temperature of 35° C. and a relative humidity of 65% for 6 months. Thereafter, the state of the liquid developer was observed, and changes in viscosity, color, acid value and electric resistance before and after allowing to stand were evaluated based on the following five grades. It should be noted that the acid value was measured according to JIS K2501. Further, the change in color of the liquid developer was evaluated visually. Still further, the viscosity was measured with a vibration viscometer according to JIS Z8809. Further, the electric resistance was measured with Universal Electrometer MMA II-17B with an electrode for liquid LP-05 and a shield box P-618 (produced by Kawaguchi Electric Works, Co., Ltd.).

A: Completely no change in viscosity, color, acid value and electric resistance found B: Substantially no change in viscosity, color, acid value and electric resistance found C: Slight change in viscosity, color, acid value and electric resistance found without problem upon using as liquid developer D: Change in viscosity, color, acid value and electric resistance clearly found E: Change in viscosity, color, acid value and electric resistance considerably found 2-3. Fixing Strength Monochrome images having a prescribed pattern were formed on recording paper (high quality paper, LPCPPA4, produced by Seiko Epson Corp.) with the liquid developers obtained in Examples and Comparative Examples using an image forming apparatus shown in FIGS. 1 to 4. The images were then heat fixed with the temperature of the heat fixing roller set to 110° C. at a fixing rate of 50 sheets per minute.

Thereafter, the non-offset area was confirmed, and then the fixed image on the recording paper was rubbed with a rubber eraser (sand eraser, LION 261-11, produced by Lion Office Products Corp.) twice with a pressing load of 1.0 kgf. The remaining rate of the image density was measured with X-Rite Model 404, produced by X-Rite, Inc., and evaluated based on the following five grades.

Excellent (A): image density remaining rate of 95% or more

Good (B): image density remaining rate of 90% or more and less than 95%

Allowable (C): image density remaining rate of 80% or more and less than 90%

Slightly poor (D): image density remaining rate of 70% or more and less than 80%

Poor (E): image density remaining rate of less than 70%

Further, when performing fixing using the liquid developer of each of Examples, there could hardly be observed a situation in which the liquid developer vaporized (generation of odor or vapor).

2-4. Low Temperature Fixing Property

The toners obtained in Examples and Comparative Examples were evaluated for favorably fixable range and low temperature fixing property.

Firstly, an image forming apparatus having the same configuration as shown in FIGS. 1 to 3 except that the apparatus had no fixing device was prepared. Image samples having an unfixed monochrome toner image formed on a recording medium (high quality paper, LPCPPA4, produced by Seiko Epson Corp.) were prepared by using the image forming apparatus.

It should be noted that the solid image on the samples had an attached amount of the toner set to 0.5 mg/cm$^2$.

Then, the surface temperature of the fixing roller of the fixing device constituting the image forming apparatus was set to a prescribed temperature, and the recording medium having the unfixed toner image formed thereon was inserted into the fixing device shown in FIG. 4, whereby the toner image was fixed to the recording medium. The occurrence of offset after fixing was then confirmed visually. In the present fixing device, the fixing rate was set 50 sheets per minute (number of sheets of A4 size paper passing through the nip section). The temperature of the surface of the fixing roller was changed sequentially within a range of from 60 to 160° C., and the occurrence of offset at the temperatures was confirmed. The maximum temperature where low temperature offset occurred was designated as a low temperature offset occurring temperature, which was evaluated based on the following four grades.

Excellent (A): low temperature offset occurring temperature of lower than 95° C.

Good (B): low temperature offset occurring temperature of 95° C. or higher and lower than 110° C.

Slightly poor (C): low temperature offset occurring temperature of 110° C. or higher and lower than 120° C.

Poor (D): low temperature offset occurring temperature of 120° C. or higher

The results obtained are shown in Table 2. Further, in the column of "Low temperature fixing property", specific values of the low temperature offset occurring temperature (° C.) are shown in parentheses.

TABLE 2

| | Toner particles | | | | | |
|---|---|---|---|---|---|---|
| | Average particle diameter (μm) | Amount of particles exceeding 5 μm (Vol %) | Storage stability | Environmental stability | Fixing strength | low temperature offset occurring temperature |
| Example 1 | 1.9 | <1.0 | A | A | A | B (100° C.) |
| Example 2 | 2.5 | <1.0 | A | A | A | A (90° C.) |
| Example 3 | 2.8 | 10.0 | A | B | B | B (100° C.) |
| Example 4 | 2.5 | 8.0 | A | A | B | A (90° C.) |
| Example 5 | 1.9 | 4.0 | A | A | B | A (93° C.) |
| Example 6 | 2.3 | <1.0 | B | B | A | A (93° C.) |
| Example 7 | 2.8 | 15.0 | B | A | A | B (98° C.) |
| Example 8 | 2.6 | 13.5 | B | A | A | A (93° C.) |
| Example 9 | 2.3 | 11.0 | B | A | A | A (85° C.) |
| Comparative Example 1 | — | — | D | E | E | D (120° C.) |
| Comparative Example 2 | 3.8 | 10.0 | E | E | E | D (120° C.) |
| Comparative Example 3 | — | — | E | E | E | D (120° C.) |
| Comparative Example 4 | 2.7 | 8.0 | C | C | E | D (120° C.) |

As can be found from Table 2, the liquid developers of Examples were superior in storage stability, long-term stability, and low-temperature fixing property. In contrast, no sufficient result was obtained with the liquid developers of Comparative Examples. Further, after the liquid developer of each of Examples was left at rest at temperature of 60° C. for 12 hours, no aggregation of the toner particles could not be observed in either liquid developer. In other words, the liquid developer of each of Examples was also superior in storage stability at high temperature.

Further, Production and evaluation of liquid developers were carried out in the same manner as above except that Pigment Red 122, Pigment Yellow 180 and carbon black (Printex L, produced by Degussa AG) were used as the colorant instead of the cyan pigment, and the similar results as above were obtained.

The entire disclosure of Japanese Patent Application No. 2007-146281, filed May 31, 2007 is expressly incorporated by reference herein.

What is claimed is:

1. A liquid developer comprising:

a toner particle mainly composed of a resin material; and a nonvolatile insulating liquid, wherein the resin material includes an ethylene copolymer, the insulating liquid includes a fatty acid triglyceride, and the toner particle includes the fatty acid triglyceride.

2. The liquid developer according to claim 1, wherein a melting point of the ethylene copolymer is Tm (° C.), a Vicat softening point of the ethylene copolymer is Tv (° C.), and $Tm-Tv \leqq 35$ (° C.) is satisfied.

3. The liquid developer according to claim 1, wherein a modulus of flexural rigidity of the ethylene copolymer measured at 25° C. in conformity to JIS K7106 is in a range of 50 through 140 MPa.

4. The liquid developer according to claim 1, wherein the ethylene copolymer includes one of an acrylic acid and a methacrylic acid as a monomer constituent.

* * * * *